US011486066B2

(12) United States Patent
Ignatzy et al.

(10) Patent No.: US 11,486,066 B2
(45) Date of Patent: Nov. 1, 2022

(54) WEAVING LOOM AND METHOD FOR WEAVING A MULTILAYER FABRIC

(71) Applicant: STAUBLI BAYREUTH GMBH, Bayreuth (DE)

(72) Inventors: Jens Ignatzy, Bayreuth (DE); Andreas Schnabel, Bindlach (DE)

(73) Assignee: STAUBLI BAYREUTH GMBH, Bayreuth (DE)

( * ) Notice: Subject to any disclaimer, the term of this patent is extended or adjusted under 35 U.S.C. 154(b) by 73 days.

(21) Appl. No.: 17/178,861

(22) Filed: Feb. 18, 2021

(65) Prior Publication Data

US 2021/0277550 A1 Sep. 9, 2021

(30) Foreign Application Priority Data

Mar. 3, 2020 (EP) ..... 20305225

(51) Int. Cl.

| | |
|---|---|
| ***D03D 49/50*** | (2006.01) |
| ***D03D 41/00*** | (2006.01) |
| ***D03D 3/00*** | (2006.01) |
| ***D03D 49/70*** | (2006.01) |

(52) U.S. Cl.

CPC ..... *D03D 41/008* (2013.01); *D03D 3/00* (2013.01); *D03D 49/70* (2013.01); *D10B 2403/03* (2013.01)

(58) Field of Classification Search

CPC ..... D03D 41/008; D03D 3/00; D03D 49/70; D03D 13/00; D03D 41/004; D03D 47/16; D03D 49/50; D03D 47/27; D03D 47/34; D10B 2403/03; D03C 3/26; D03C 3/12; D03J 1/04

See application file for complete search history.

(56) References Cited

U.S. PATENT DOCUMENTS

| | | | | |
|---|---|---|---|---|
| 3,014,504 | A * | 12/1961 | Pfarrwaller | D03D 49/70 139/263 |
| 2002/0069927 | A1* | 6/2002 | Bryn | D03D 13/002 139/48 |
| 2004/0168738 | A1* | 9/2004 | Bryn | D03D 13/002 139/383 R |
| 2019/0264352 | A1* | 8/2019 | Schnabel | D03D 13/00 |
| 2021/0277550 | A1* | 9/2021 | Ignatzy | D03D 49/70 |

FOREIGN PATENT DOCUMENTS

| | | | |
|---|---|---|---|
| DE | 102015109785 | A1 | 12/2016 |
| EP | 3121317 | A1 | 1/2017 |

OTHER PUBLICATIONS

European Search Report dated Sep. 3, 2020, for Europe Application No. 20305225.3 filed Mar. 3, 2020.

* cited by examiner

*Primary Examiner* — Robert H Muromoto, Jr.

(57) ABSTRACT

A weaving loom for weaving a multilayer fabric with weft insertion mechanism (90) and main heddles moved by a Jacquard main shedding mechanism for guiding main warp yarns (12) and defining a main harness width (W11). According to the invention, the weaving loom includes auxiliary heddles (21) moved by an auxiliary shedding mechanism, for guiding auxiliary warp yarns (22) and defining a clamping area (W21) arranged within the main harness width (W11). At a first pick, the auxiliary heddles are configured for closing the auxiliary shed of auxiliary warp yarns for clamping an inserted weft (100) while the main shed is still open.

18 Claims, 13 Drawing Sheets

WEAVING LOOM AND METHOD FOR WEAVING A MULTILAYER FABRIC

The invention concerns a weaving loom for weaving a multilayer fabric and a method for weaving a multilayer fabric.

It is known to weave warp yarns and weft according to a multilayer pattern for creating a three-dimensional preform. This type of preform may be used for manufacturing three-dimensional composite parts, such as fan blades or the like.

EP3121317A1 discloses a method for weaving fabric, wherein, during drawing of a weft into a shed of warp yarns, warp yarns of a predetermined group are moved to a semi-closed position for closing the shed around the inserted weft. Thus, the inserted weft is guided or clamped by the yarns of this group during its translational movement, enabling correct and precise positioning of the weft even if the weft has been cut to a relatively short length compared to the total width of the fabric.

However, implementing this method requires using an advanced loom, including individual actuators all along the harness width for driving of the heddles. This type of loom is complex and expensive. Additionally, while the sole role of the group of yarns is facilitating the weaving by guiding or clamping the weft, this group of yarns remains interwoven in the finished fabric. Thus, it is difficult to choose yarns suitable for remaining in the finished fabric and suitable for correctly guiding or clamping the weft without breaking.

DE102015109785 discloses a woven two-dimensional fabric for use in producing three-dimensional composite part. The fabric includes shortened reinforcing yarns, which are bound by binding yarns. However, the reinforcing yarns are not held during weaving, so that an unsatisfactory positioning of the reinforcing yarns may occur.

An aim of the invention is to solve the aforementioned problems and to provide a new weaving loom of simpler structure while enabling clamping of weft during weaving.

The invention concerns a weaving loom for weaving a multilayer fabric comprising warp yarns and weft yarns, the weft yarns being of different lengths, wherein the weaving loom comprises: insertion means, configured for: picking a weft at a pickup position along a weft axis of the weaving loom, drawing the weft from the pickup position into a shed of warp yarns along the weft axis, and releasing the weft at a given position along the weft axis. The weaving loom comprises main heddles, configured for guiding main warp yarns and defining a main harness width along the weft axis. The weaving loom comprises a main shedding mechanism of the Jacquard type, configured for moving the main heddles along a vertical path. The weaving loom comprises a set of first auxiliary heddles, configured for guiding first auxiliary warp yarns and defining a first clamping area along the weft axis, the first clamping area being arranged within the main harness width. The weaving loom comprises a first auxiliary shedding mechanism, configured for moving the first auxiliary heddles. The weaving loom is configured for, at a first pick, opening a main shed of main warp yarns by means of the main heddles, moved by the main shedding mechanism, and opening a first auxiliary shed of first auxiliary warp yarns by means of the first auxiliary heddles, moved by the first auxiliary shedding mechanism, for the insertion of a first weft by the insertion means; and configured for, at said first pick, closing the first auxiliary shed by means of the first auxiliary heddles, moved by the first auxiliary shedding mechanism, for clamping the first weft with the first auxiliary warp yarns in the first clamping area, after the insertion means have drawn the first weft through the first clamping area and while the main shed is still open.

The weaving loom of the invention is implemented with the first auxiliary shedding mechanism, dedicated to the positioning of the first auxiliary warp through the first auxiliary heddles, and implemented as a separate structure from the main shedding mechanism. Thus, the first auxiliary shedding mechanism and the first auxiliary heddles may be dedicated to the clamping of weft at any pick. The first auxiliary shedding mechanism may be designed specifically for this purpose, while the main shedding mechanism may remain generic. The main shedding mechanism may advantageously be implemented as a mechanism including selectable hooks and blades for driving the main heddles, less costly than a mechanism implying individual heddle actuators. However, the first auxiliary shedding mechanism may be more specific to the weft clamping requirements, for example by including individual actuators for driving the first auxiliary heddles.

In another embodiment, an existing weaving loom, initially unable to achieve weft clamping, may be upgraded to the weaving loom according to the invention, by adding the auxiliary shedding mechanism and the first auxiliary heddles, so as to enable weft clamping.

Additional optional features of the invention are given below.

Preferably, the first auxiliary shedding mechanism is configured for closing the first auxiliary shed for clamping the first weft while the insertion means are still drawing the first weft into the main shed.

Preferably, the weaving loom comprises a set of second auxiliary heddles, configured for guiding second auxiliary warp yarns and defining a second clamping area along the weft axis, the second clamping area being arranged within the main harness width; and comprises a second auxiliary shedding mechanism, configured for moving the second auxiliary heddles. Preferably, the first clamping area is arranged between the pickup position and the second clamping area. Preferably, the weaving loom is configured for, at said first pick, opening a second auxiliary shed of second auxiliary warp yarns, by means of the second auxiliary heddles, moved by the second auxiliary shedding mechanism, for the insertion of the first weft by the insertion means, and configured for, at said first pick, closing the second auxiliary shed by means of the second auxiliary heddles, moved by the second auxiliary shedding mechanism, for clamping the first weft with the second auxiliary warp yarns in the second clamping area, after the insertion means have drawn the first weft through the second clamping area and while the main shed is still open.

Preferably, the first auxiliary shedding mechanism is configured for closing the first auxiliary shed for clamping the first weft while the insertion means draw the first weft into the second clamping area.

Preferably, the weaving loom comprises a girder, supporting the first auxiliary shedding mechanism, the first auxiliary shedding mechanism being adjustable in position along the girder, parallel to the weft axis.

Preferably, the first auxiliary shedding mechanism comprises a primary actuator for moving a primary auxiliary heddle, among the first auxiliary heddles, according to a primary reciprocating movement; and comprises a secondary actuator for moving a secondary auxiliary heddle, among the first auxiliary heddles, according to a secondary reciprocating movement opposite to the primary reciprocating movement, with an adjustable crossing point.

Preferably, the first auxiliary shedding mechanism comprises at least one actuator, comprising a stator and a pulley driven in rotation relative to the stator; and each pulley is configured to move at least one of the first auxiliary heddles, preferably three first auxiliary heddles.

Preferably, the main shedding mechanism comprises selectable hooks, each driving at least one of the main heddles; blades, for driving the selectable hooks between an upward and a downward position; and a main shaft for driving the blades.

The invention also concerns a method for weaving a multilayer fabric comprising warp yarns and weft, the weft yarns being of different lengths, by means of a weaving loom comprising: insertion means, configured for picking a weft at a pickup position along a weft axis of the weaving loom, for drawing the weft from the pickup position into a shed of warp yarns along the weft axis, and for releasing the weft at a given position along the weft axis. The weaving loom comprises main heddles, configured for guiding main warp yarns and defining a main harness width along the weft axis. The weaving loom comprises a main shedding mechanism of the Jacquard type, configured for moving the main heddles vertically along a vertical path. The weaving loom comprises a set of first auxiliary heddles, configured for guiding first auxiliary warp yarns and defining a first clamping area along the weft axis, the first clamping area being arranged within the main harness width. The weaving loom comprises a first auxiliary shedding mechanism, configured for moving the first auxiliary heddles.

The method comprises, at a first pick, opening a main shed of main warp yarns by means of the main heddles, moved by the main shedding mechanism, and opening a first auxiliary shed of auxiliary warp yarns by means of the first auxiliary heddles, moved by the first auxiliary shedding mechanism; by means of the insertion means, picking a first weft at the pickup position; by means of the insertion means, drawing the first weft from the pickup position into the main shed and into the first auxiliary shed; closing the first auxiliary shed by means of the first auxiliary heddles, moved by the first auxiliary shedding mechanism, for clamping the first weft with the first auxiliary warp yarns in the first clamping area, after the insertion means have drawn the first weft through the first clamping area and while the main shed is still open; by means of the insertion means, releasing the first weft; and by means of the main heddles, closing the main shed.

Additional optional features of the invention are given below.

Preferably, during said first pick, the first auxiliary shedding mechanism closes the first auxiliary shed for clamping the first weft after the insertion means have drawn the first weft through the first clamping area and while the insertion means are still drawing the first weft into the main shed.

Preferably, the weaving loom comprises: a set of second auxiliary heddles, configured for guiding second auxiliary warp yarns and defining a second clamping area along the weft axis, the second clamping area being arranged within the main harness width; and a second auxiliary shedding mechanism, configured for moving the second auxiliary heddles. Preferably, the first clamping area is arranged between the pickup position and the second clamping area. In this case, the method may comprise, at said first pick: opening a second auxiliary shed, by means of the second auxiliary heddles, moved by the second auxiliary shedding mechanism, wherein drawing the first weft by means of the insertion means comprises drawing the first weft into the second auxiliary shed, and closing the second auxiliary shed by means of the second auxiliary heddles, moved by the second auxiliary shedding mechanism, for clamping the first weft with the second auxiliary warp yarns in the second clamping area, after the insertion means have drawn the first weft into the second clamping area, while the main shed is still open, and before the insertion means release the first weft.

Preferably, the method further comprises, at said first pick, after picking the first weft, cutting the first weft at a given length equal to a distance from the first clamping area to the second clamping area, along the weft axis.

Preferably, the method further comprises, at a second pick executed after the first pick: opening the main shed by means of the main heddles, moved by the main shedding mechanism, and opening the first auxiliary shed by means of the first auxiliary heddles, moved by the first auxiliary shedding mechanism; by means of the insertion means, picking a second weft at the pickup position; by means of the insertion means, drawing the second weft from the pickup position into the main shed and into the first auxiliary shed; closing the first auxiliary shed by means of the first auxiliary heddles, moved by the first auxiliary shedding mechanism for clamping the second weft with the first auxiliary warp yarns in the first clamping area, after the insertion means have drawn the second weft through the first clamping area and while the main shed is still open; by means of the insertion means, releasing the second weft; and by means of the main heddles, closing the main shed. Preferably, opening the first auxiliary shed at the second pick comprises uncrossing any first auxiliary warp yarns that were crossed around the first weft during the first pick, so that, at the end of the second pick, the first weft and second weft are stacked together without being separated by any first auxiliary warp yarn.

Preferably, the weaving loom comprises: a set of third auxiliary heddles, configured for guiding third auxiliary warp yarns and defining a third clamping area along the weft axis, the third clamping area being arranged within the main harness width; a third auxiliary shedding mechanism, configured for moving the third auxiliary heddles. Preferably, the method further comprises, at a middle pick executed after the first pick: opening of the main shed by means of the main heddles, moved by the main shedding mechanism, so that the first weft is positioned over or under the main shed; by means of the insertion means, picking a middle weft at the pickup position; by means of the insertion means, drawing the middle weft from the pickup position into the main shed; by means of the insertion means, releasing the middle weft; and by means of the main heddles, moved by the main shedding mechanism, closing the main shed, so that the first weft and the middle weft are superposed in a same pick stack. Preferably, the method further comprises, at a third pick executed after the middle pick: opening of the main shed by means of the main heddles, moved by the main shedding mechanism, and opening of a third auxiliary shed of third auxiliary warp yarns by means of the third auxiliary heddles, moved by the third auxiliary shedding mechanism, so that the middle weft is positioned between the first weft and the main shed; by means of the insertion means, picking a third weft at the pickup position; by means of the insertion means, drawing the third weft from the pickup position into the main shed and into the third auxiliary shed; closing the third auxiliary shed by means of the third auxiliary heddles, moved by the third auxiliary shedding mechanism, for clamping the third weft with the third auxiliary warp yarns in the third clamping area, after the insertion means have drawn the third weft through the third clamping area and while the main shed is still open; by means of the insertion means, releasing the third weft; and by means of the main heddles, closing the main shed, so that the first weft, the middle weft and the third weft are superposed in a same pick stack, with the middle weft between the first weft and the third weft.

Preferably, the method comprises, during the middle pick: maintaining the first auxiliary heddles over the weft axis; and maintaining the third auxiliary heddles under the weft axis.

Preferably, the method comprises, at the middle pick: opening the first auxiliary shed by means of the first auxiliary heddles, moved by the first auxiliary shedding mechanism, so that the middle weft is inserted into the first auxiliary shed by the insertion means; and/or opening the third auxiliary shed by means of the third auxiliary heddles, moved by the third auxiliary shedding mechanism, so that the middle weft is inserted into the third auxiliary shed by the insertion means.

Preferably, the method comprises, at the first pick, increasing a tension of the first auxiliary warp yarns while closing the first auxiliary shed for clamping the first weft with the tensioned first auxiliary warp yarns.

The invention will be better understood on the basis of the following description, which is given in correspondence with the annexed figures and as an illustrative example, without restricting the object of the invention. In the annexed figures.

Figure 1:
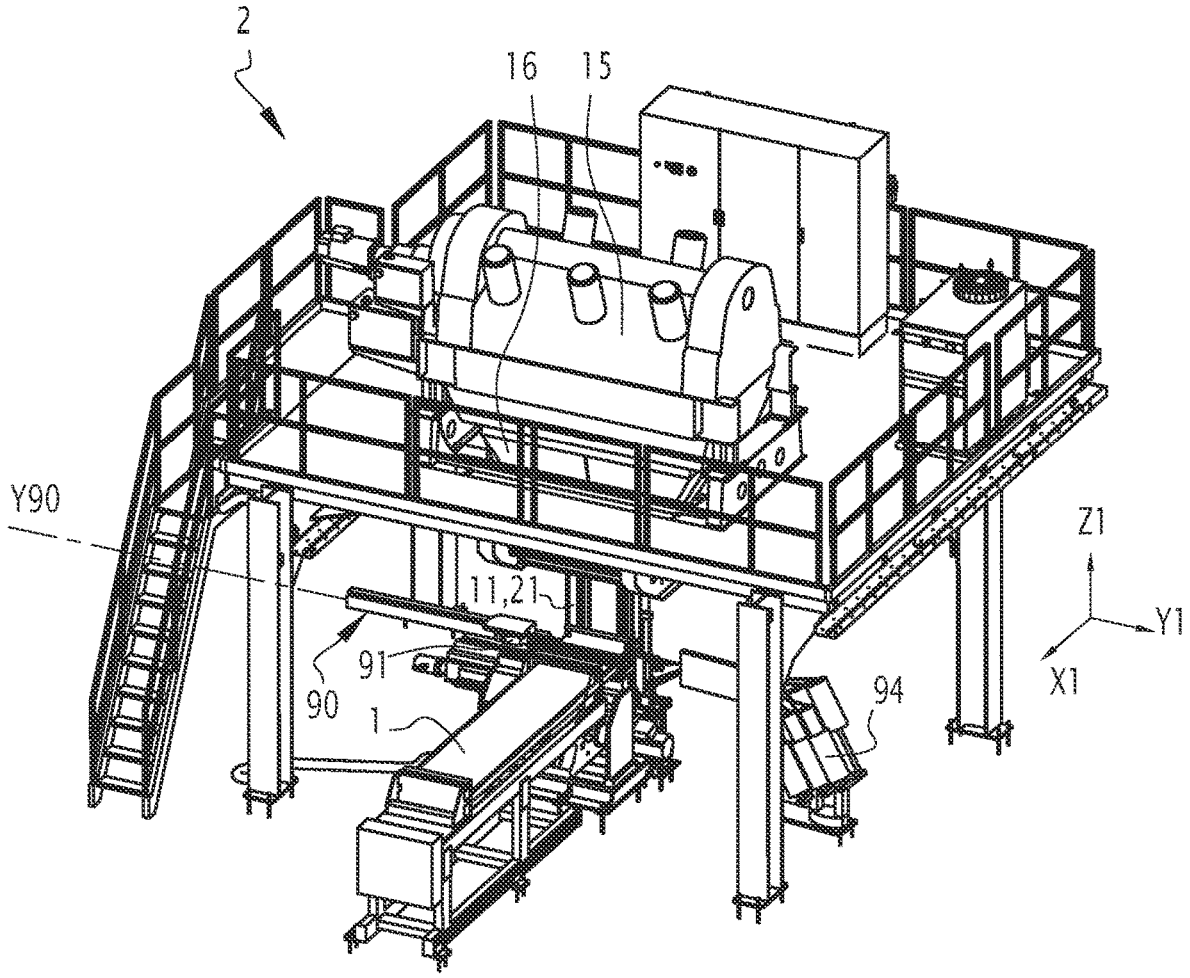
FIG. 1 is a perspective view of a weaving loom according to the invention.
Figure 2:
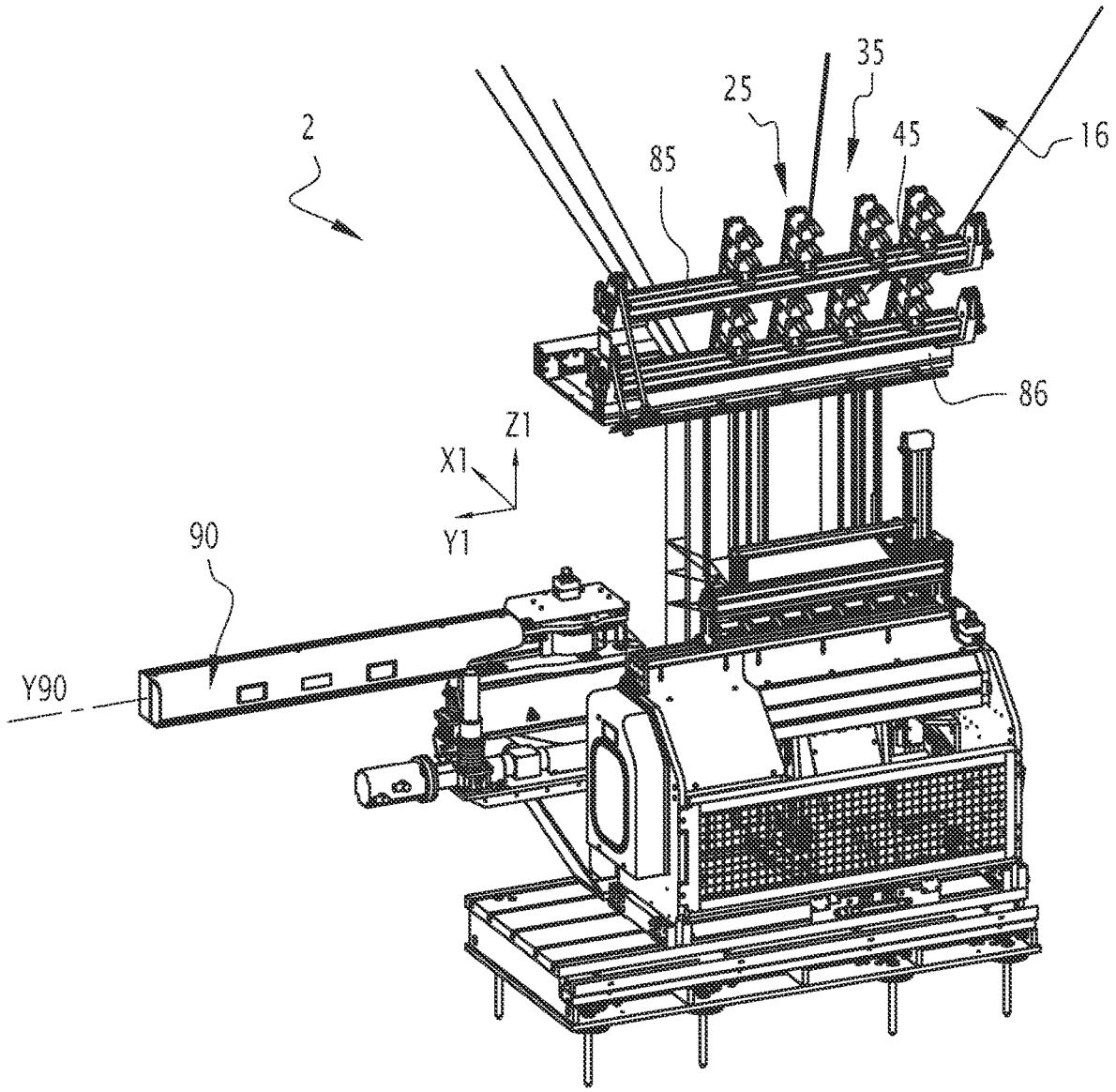
FIG. 2 is a partial perspective view of a part of the weaving loom of FIG. 1.
Figure 3:
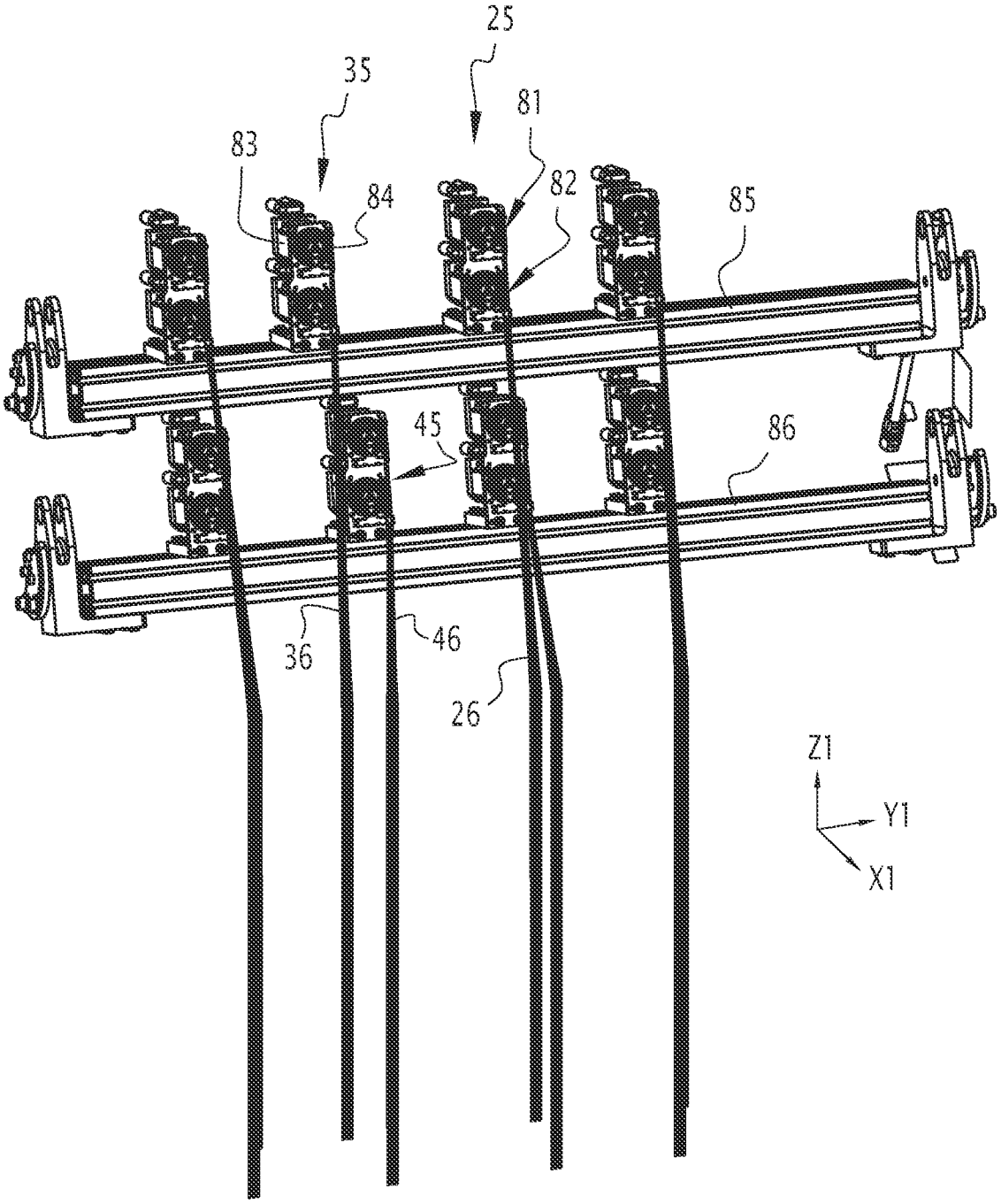
FIG. 3 is a partial perspective view of a detail of the weaving loom of FIG. 2.

FIGS. 1-3 show a weaving loom 2 according to the invention. This loom 2 is used to weave together warp yarns and weft yarns, for forming a multilayer fabric 1 of woven continuous yarns, shown more specifically on FIGS. 4 and 5.

Figure 4:
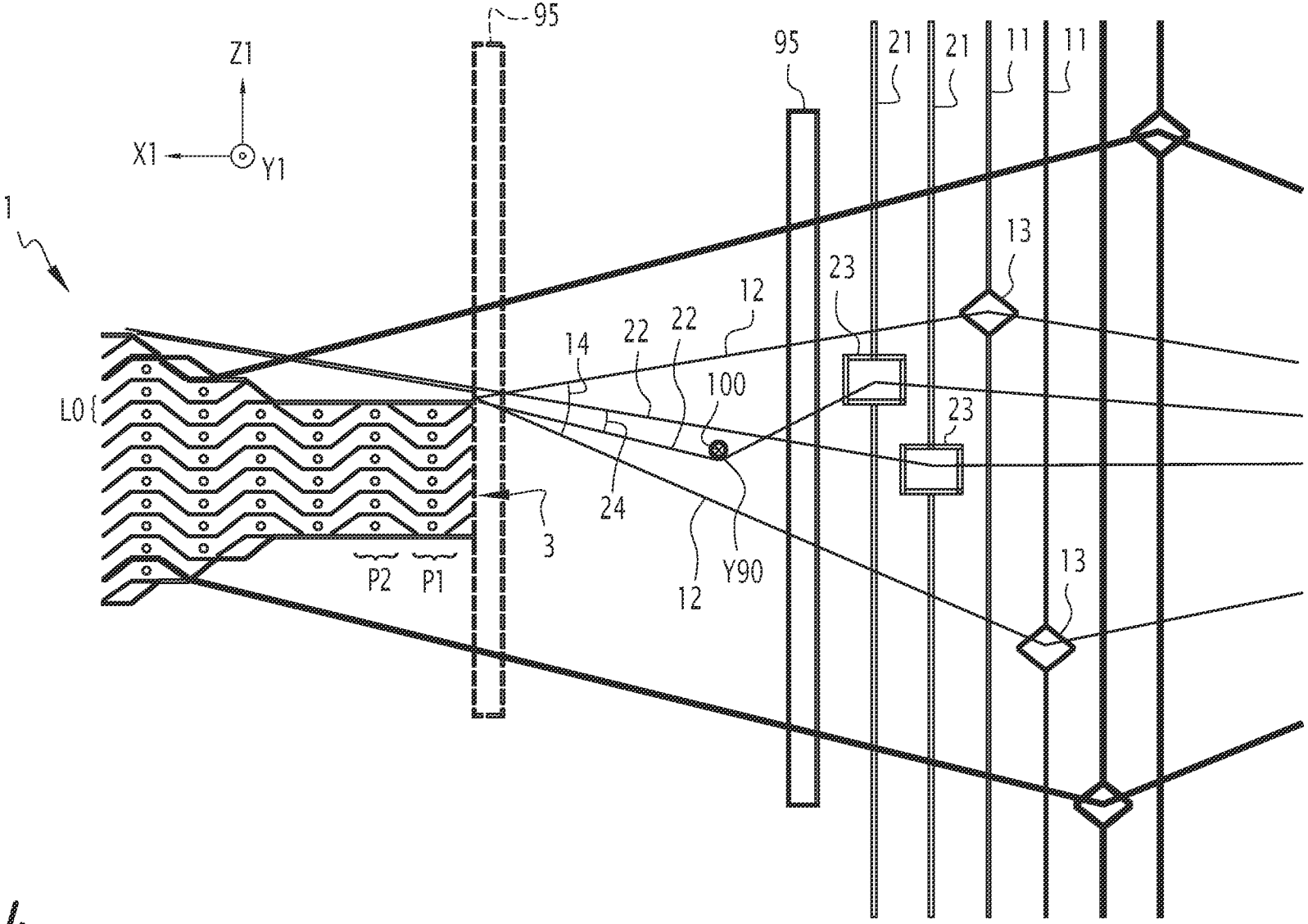
FIG. 4 is a schematic view of a part of the weaving loom of FIGS. 1-3, showing a partial longitudinal cross-section of a multilayer fabric being woven by the weaving loom.
Figure 5:
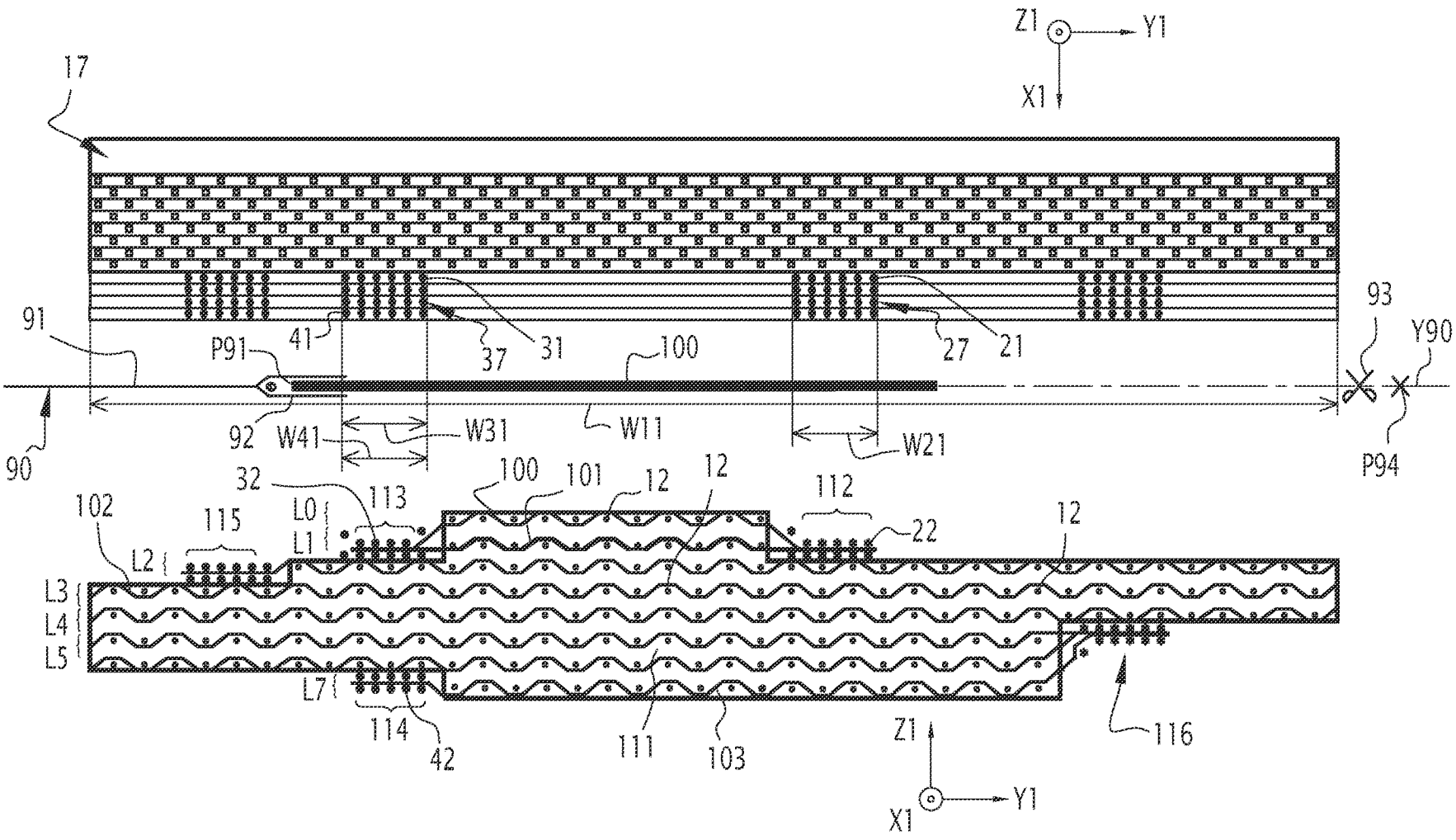
FIG. 5 is a hybrid view of a part of the weaving loom of FIGS. 1-4, showing, at the top, a top view of the multilayer fabric being woven by the weaving loom, and at the bottom, a transversal cross section of the woven fabric, the fabric at the bottom being shown at a same scale and being positioned a same coordinate along a direction Y1.

As shown in FIGS. 4 and 5, the multilayer fabric 1 comprises inwoven weft yarns, shown in cross-sections in FIG. 4, and warp yarns, shown in cross-sections in FIG. 5. The fabric 1 defines a warp direction X1, a weft direction Y1 and a layer direction Z1. The warp yarns are generally oriented along the warp direction X1. The weft yarns are generally oriented along the weft direction Y1.

The multilayer fabric 1 may be qualified of technical fabric. Preferably, the multilayer fabric 1 is configured to constitute a tri-dimensional preform for the manufacturing of three-dimensional parts of composite material, including said preform impregnated with a reinforcing resin or the like. The manufactured part may be a fan blade or the like.

In FIG. 4, the multilayer fabric 1 is shown during weaving. In this situation, the unfinished fabric 1 comprises a cloth fell 3, i.e. a front edge oriented parallel to direction Y1 where the yarns are being woven.

As shown in FIGS. 4 and 5, the multilayer fabric 1 comprises successive layers, oriented parallel to directions X1 and Y1 and distributed parallel to direction Z1, each layer being formed by inwoven weft yarns and warp yarns, the adjacent layers being interleaved by inter-weaving of the warp and weft yarns of said layers. In the example FIGS. 4 and 5, layers L0, L1, L2, L3, L4, L5 and L7 of the fabric 1 are identified.

In the multilayer fabric 1, the weft included at a given layer may have a length different from the length of the weft included at a subsequent layer. For example, as shown in FIG. 5, the weft 100 of layer L0 is shorter than the weft of layer L2, below the layer L0. Thus, the multilayer fabric 1 may be shaped so as to constitute a near-net preform.

The multilayer fabric 1 comprises successive pick stacks, oriented parallel to directions Y1 and Z1 and distributed parallel to direction X1, each pick stack being made of inwoven weft and warp yarns, the adjacent picks stacks being interleaved by inter-weaving of the warps and weft of said pick stacks. A pick stack P1 is identified in FIG. 4, comprising six superposed weft yarns. The pick stack P1 is located at the cloth fell 3. A successive pick stack P2 is shown in FIG. 4.

A creel including yarn packages, or a warp beam stand, or any other warp delivery unit, feeds the loom 2 with warp yarns. The warp yarns for feeding the loom enter the fabric 1 at the cloth fell 3. The warp delivery unit is located in direction opposite to direction X1 relative to the fabric 1. A cloth beam or any other receiving unit, not shown, is implemented in the direction X1 relative to the delivery unit, for receiving the fabric 1 woven by the loom 2, at en edge of the fabric 1 opposed to the cloth fell 3.

The loom 2 comprises main heddles 11 and auxiliary heddles, including auxiliary heddles 21, 31 and 41 shown in FIGS. 4 and 5. The main and auxiliary heddles 11, 21, 31, 41 are positioned in a direction opposite to direction X1 relative to the cloth fell 3, between the warp delivery unit and the cloth fell 3. The main heddles 11 are configured for guiding main warp yarns 12 fed by the warp delivery unit to the cloth fell 3, in particular along a vertical path. The auxiliary heddles are configured for guiding auxiliary warp yarns fed by the warp delivery unit to the cloth fell 3, in particular along a vertical path. The main warp yarns may also be called "product warp yarns". The auxiliary warps yarns may also be called "process warp yarns" or "process and product warp yarns".

In particular, the auxiliary heddles 21, 31 and 41 respectively guide auxiliary warp yarns 22, 32 and 42, shown in FIGS. 4 and 5. For this purpose, each main heddle 11 comprises a main eyelet 13 receiving the main warp yarn 12 moved by this heddle 11.

Each auxiliary heddle, such as the heddles 21, comprises an auxiliary eyelet, such as the auxiliary eyelet 23, receiving the auxiliary warp yarn, such as the warp yarn 22 moved by this heddle 21.

The main heddles 11 may be selectively moved reciprocally along a path parallel to direction Z1, here vertical, for successively opening and closing a main shed 14 of main warp yarns 12 during the successive weaving picks.

The opening of the main shed 14 is achieved by the main heddles 11 selectively pulling up or down each main warp yarn 12 from a crossing-point position. The closing of the main shed 14 is achieved by the main heddles 11 selectively pulling the main warp yarns 12 back to the crossing-point. At each pick, the opened main shed 14 may be of different shape than at the preceding pick, i.e. may imply a different combination of pulled up main warp yarns 12 and pulled down main warp yarns 12, depending on the intended weave.

The main heddles 11 are distributed along a main harness width W11 along a weft axis Y90, shown schematically on FIG. 5.

The main harness width W11 corresponds to a distance, along the weft axis Y90, measured from one of the two extremal main heddles 11 to the other, or from one of the two extremal main warp yarns 12 to the other. The main harness width W11 also corresponds to the maximal width of fabric that may be woven with the loom 2, measured parallel to the weft direction Y1.

The weft axis Y90 is parallel to the weft direction Y1. As shown schematically in FIG. 4, the cloth fell 3 is positioned in direction X1 relative to the weft axis Y90, while the weft axis Y90 is parallel to weft direction Y1 and positioned in direction X1 relative to the main heddles 11.

The main heddles 11 are moved, i.e. actuated by a main shedding mechanism 15 of the loom 2, visible on FIG. 1. The main shedding mechanism 15 is positioned in the direction Z1 relative to the heddles 11, i.e. over the heddles 11. For being actuated, the main heddles 11 are connected to the shedding mechanism 15 by means of a main harness 16 of the loom 2, the main harness 16 comprising a plurality of harness cords, each harness cord connecting one or a group of heddles 11 to the shedding mechanism 15. The harness 16 advantageously comprises a main cumberboard 17, interposed between the main shedding mechanism 15 and the main heddles 11, each main heddle 11 passing through a respective aperture of the cumberboard 17 for being guided by the cumberboard 17. Thus, the cumberboard 17 ensures correct positioning and guides the movement of the heddles 11. The cumberboard 17 is preferably oriented parallel to the directions Y1 and X1.

The main shedding mechanism 15 is of the Jacquard type. In other words, the mechanism 15 enables actuating each main heddle 11 or groups of main heddles 11 according to a user-defined non-repeated sequence, independent from the sequence of the other heddles 11 or group of heddles 11. Preferably, the main shedding mechanism 15 is a mechanical or electronic Jacquard machine. In general, this type of shedding mechanism exclusively enables driving the main heddles according to a ring-bell profile, or at least only enables programming the movements of the heddles to a limited number of different positions such as top position, bottom position, and sometimes middle position in particular for superposed rapier application, according to a fixed pattern of movement. In a preferred embodiment, the main shedding mechanism 15 comprises selectable hooks, each hook, or pair of hooks, driving a single main heddle 11 or a group of main heddles 11. Each main heddle 11 or group of main heddles 11 is suspended to one hook or to a pair of hooks through one of the cords of the main harness 16. The hooks are selectively suspended, for example through electromagnetic selection means, on two parallel blades of the main shedding mechanism 15, parallel to the weft direction Y1. Each of the blades is actuated according to an opposite reciprocating movement, for driving the selectable hooks between an upward and a downward position. The main shedding mechanism 15 also comprises a common main shaft or actuator for driving the blades. The main shaft is synchronized with the main shaft of the weaving loom. With this embodiment where the main shedding mechanism 15 comprises a single actuator for selectively driving the main heddles, the mechanism 15 remains less costly and less complex than a shedding mechanism which would imply actuation of the heddles through several individual actuators.

The auxiliary heddles are distributed in separate sets. For example, eight sets of several auxiliary heddles may be implemented for the loom 2, including the set of auxiliary heddles 21, the set of auxiliary heddles 31 and the set of auxiliary heddles 41. Preferably, each set of auxiliary heddles comprises at least three auxiliary heddles. Preferably, each set of auxiliary heddles comprises less than twenty, preferably less than ten, preferably less than five, preferably exactly three auxiliary heddles.

For each set, the auxiliary heddles may be selectively moved reciprocally along a path parallel to direction Z1, here vertical, for successively opening and closing an auxiliary shed of auxiliary warp yarns during each successive weaving pick. Each auxiliary shed is respective to one set of auxiliary heddles and always concern the same set of auxiliary warp yarns. As shown in FIG. 4, the auxiliary heddles 21 open and close an auxiliary shed 24 of auxiliary warp yarns 22.

The opening of the auxiliary shed is achieved by its respective set of auxiliary heddles. These auxiliary heddles selectively pull up or down each auxiliary warp yarn of this set, from a crossing-point position. The closing of the auxiliary shed is achieved by the auxiliary heddles of this set, selectively pulling the auxiliary warp yarns of this set back to the crossing-point. At each pick, for a given set, the opened auxiliary shed may be of different shape than at the preceding pick, i.e. may imply a different combination of pulled up auxiliary warp yarns and pulled down auxiliary warp yarns, depending on the intended weave.

For each set, the auxiliary heddles are distributed, along a clamping area along the weft axis Y90, as shown schematically on FIG. 5. In particular, the auxiliary heddles 21 define a clamping area W21, the auxiliary heddles 31 define a clamping area W31 and the auxiliary heddles 41 define a clamping area W41. Along each clamping area, the auxiliary heddles of the same set are grouped, so that each clamping area is small compared to the harness width W11, such as between one tenth and one thousandth, or even less, of the size of the harness width W11. Preferably, for each set, the auxiliary heddles are immediately adjacent to one another. For each set, the clamping area corresponds to a distance, along the weft axis Y90, measured from one of the two extremal auxiliary heddle to the other, or from one of the two extremal auxiliary warp yarns of this set to the other.

Each clamping area is entirely arranged within the main harness width W11, i.e. covers only a small portion of the main harness width W11, without extending beyond the ends of the main harness width W11. The clamping areas may be separated from one another, may overlap, or be superposed. For example, the clamping area W21 is separated from the clamping area W31 along the weft axis Y90. The clamping area W31 and W41 are superposed along the weft axis Y90.

For each set, the auxiliary heddles are moved, i.e. actuated by a respective auxiliary shedding mechanism of the loom 2. The auxiliary shedding mechanism may be controlled by a same main control unit than the main shedding mechanism, or a separate auxiliary control unit synchronized with the main control unit of the loom 2.

As visible on FIG. 3, the auxiliary heddles 21 are moved by an auxiliary shedding mechanism 25, the auxiliary heddles 31 are moved by an auxiliary shedding mechanism 35, the auxiliary heddles 41 are moved by an auxiliary shedding mechanism 45. For each set, the auxiliary shedding mechanism is positioned in the direction Z1 relative to the auxiliary heddles it drives. For being actuated, the auxiliary heddles are connected to the shedding mechanism of the concerned set by means of an auxiliary harness of the loom 2, respective to the set. For example, the heddles 21 are driven by an auxiliary harness 26, the heddles 31 are driven by an auxiliary harness 36 and the heddles 41 are driven by an auxiliary harness 46. Each auxiliary harness comprises a plurality of harness cords, each harness cord connecting one or a group of auxiliary heddles of the concerned set to the shedding mechanism of the same set. As shown in FIG. 5, the main cumberboard 17 is advantageously combined with auxiliary cumberboards, including auxiliary cumberboards 27 and 37. For each set, each auxiliary heddle passes through a respective aperture of one of the auxiliary cumberboards for being guided thereby. Thus, the auxiliary cumberboards ensure correct positioning and guiding of the auxiliary heddles and their harness cords. Preferably, each auxiliary heddle set is hosted by only one auxiliary cumberboard. One auxiliary cumberboard may host several auxiliary heddle sets. For example, the auxiliary heddles 21 all pass through the auxiliary cumberboard 27, while the auxiliary heddles 31 and 41 all pass through respective portions of the auxiliary cumberboard 37. Here, cumberboard 37 is shared by the heddles 31 and 41.

Positioning of the auxiliary cumberboard defines the position of the corresponding clamping area, as shown in FIG. 5. For example, the auxiliary cumberboard 27 is positioned at the same position than the clamping area W21 along axis Y90.

As shown in FIG. 5, each auxiliary cumberboard may be removably or permanently attached to an edge of the main cumberboard 17. An advantage of this embodiment is to enable addition and/or removal and/or position adjustment of auxiliary cumberboards, depending on the needs for auxiliary heddle sets. Alternatively, the auxiliary cumberboards may be integrated to the main cumberboard, i.e. all the main and auxiliary heddles are passed through a single common cumberboard.

As shown in FIG. 3, each auxiliary shedding mechanism preferably comprises a primary actuator 81 and a secondary actuator 82, which are of separate structure and which may be controlled independently for producing an independent actuation from one another and from the actuators of the other auxiliary shedding mechanisms. Each actuator 81 and 82 is preferably an electric servo-motor. In detail, each of the actuators 81 and 82 preferably comprises a stator 83 and a pulley 84, mounted on a rotor of the actuator for being driven in rotation relative to the rotor by an electromagnetic interaction of the stator 83 with the rotor, under electric powering and control.

Each pulley 84 drives at least one auxiliary harness chord, preferably three harness chords, for driving three respective auxiliary heddles. It is preferred that three or more auxiliary heddles are driven by each actuator of the auxiliary mechanism, so that a significant auxiliary shed is driven for satisfactory clamping the inserted weft, as explained below.

For each set, the auxiliary heddles are constituted of primary auxiliary heddles, driven by the primary actuator 81, and secondary auxiliary heddles, driven by the secondary actuator 82. For example, on FIG. 4, the left auxiliary heddle 21 is one of the primary auxiliary heddles, while the right auxiliary heddle 21 is one of the secondary auxiliary heddles of the set of heddles 21. For each set, the primary auxiliary heddles are driven according to a primary reciprocating movement for forming a primary side of the auxiliary shed, for example the top of the shed, while the secondary auxiliary heddles are driven according to a secondary reciprocating movement, for forming an opposite side of the auxiliary shed, for example the bottom of the shed. The secondary reciprocating movement is opposed to the primary reciprocating movement. Since the primary and secondary auxiliary heddles are driven by two independent actuators 81 and 82, the crossing point of their reciprocating movement may be adjusted during weaving depending on the needs.

Alternatively, each auxiliary shedding mechanism may have only one actuator including a stator and a pulley, said pulley actuating the primary and secondary auxiliary heddles. In this case, the crossing point is at a fixed position during weaving.

Alternatively, a first auxiliary warp yarn guided by a first auxiliary heddle which is driven by a an actuator of the auxiliary mechanism can form an auxiliary shed with a main warp yarn, so that the auxiliary warp yarn can be moved toward the main warp yarn for clamping the weft in a clamping area after the insertion means have drawn a weft through the clamping area.

In any case, the loom 2 preferably comprises a small number of actuators, the main actuator of the main shedding mechanisms, and some more actuators for the auxiliary shedding mechanisms.

Each chord of the auxiliary harnesses may drive more than one auxiliary heddle, so that less than three chords may be implemented for each actuator 81 and 82 although more auxiliary heddles are actually driven. More generally, more or less than three auxiliary harness chords may be driven by each of the actuators 81 and 82. Also, more or less than three auxiliary heddles may be driven by each actuator 81 and 82.

In alternative, a pulley 84 of an actuator 81 or 82 drives an auxiliary chord which drives two or more auxiliary heddles connected to the auxiliary harness chord, so that the pulley drives corresponding a set of auxiliary heddles guiding auxiliary warp yarns in similar reciprocating movement. For example a non-represented upper plastic coupling comprises two housings to receive a pair of corresponding adjacent upper extremities of auxiliary heddles.

In alternative, two or more auxiliary heddles are connected below their eyelet, with a non-represented coupling means, for example a lower plastic coupling with respective vertical reception grooves for receiving corresponding adjacent lower extremities of auxiliary heddles, and a groove to connect one chord, so that they can benefit of similar return means, for example return means with a strong load. Advantageously, the chord might be connected to the lower plastic coupling with a knot so that the height of the auxiliary heddle and the eyelet is set as desired.

The heddles are drawn backward with well-known return means like weights or elastic means, for example vertical springs connected to a stationary frame at the bottom of the machine.

In another alternative, two adjacent springs can be replaced by a single spring connected to a non-represented lower plastic coupling.

As shown in FIG. 3, the loom preferably comprises two girders 85 and 86, oriented parallel to the direction Y1. The girders 85 and 86 are preferably placed close to the main harness 16, so as to obtain the smallest angles for the chords of the auxiliary harnesses. More precisely, parallel to direction Y1, the girders 85 and 86 are advantageously positioned in correspondence with the main harness width W11. The girders 85 and 86 are preferably positioned in direction Z1 relative to the main cumberboard 17 and/or to the auxiliary cumberboard. The girders 85 and 86 are advantageously connected to a fixed part of loom 2 by means of swiveling connections, so that the girders 85 and 86 may be swiveled away from the main harness 16 for maintenance or checking.

Each auxiliary shedding mechanism is supported by one of the girders 85 and 86. As shown in FIG. 3, the mechanisms 25 and 35 are supported by the girder 85, whereas the mechanism 45 is supported by the girder 86. In the present example, each girder respectively supports a total of four auxiliary shedding mechanisms. Parallel to direction Y1, each auxiliary shedding mechanism is positioned approximately in correspondence with the clamping area defined by the auxiliary heddles driven by the concerned auxiliary shedding mechanism, so as to obtain the smallest angles for the chords of the auxiliary harnesses.

In use of the loom 2, each auxiliary shedding mechanism is fixedly supported by its girder. Before weaving, the position of each auxiliary shedding mechanism may be adjusted along the supporting girder, for adjusting the position of the shedding mechanisms parallel to the weft axis Y90. Also, before weaving, each auxiliary shedding mechanism may be removed from the girders, or additional auxiliary shedding mechanisms may be added to the girders. Corresponding auxiliary heddles sets may thus be conveniently removed or added to the loom 2, depending on the fabric to be obtained or depending on the process to operate the fabric. Thus the auxiliary heddles and shedding mechanisms are highly versatile. Also, an existing loom may easily be provided with auxiliary shedding mechanisms.

Preferably, the two auxiliary shedding mechanisms 35 and 45 are distributed respectively on the two girders 85 and 86 at a corresponding position along axis Y90, so as to enable sharing the auxiliary cumberboard 37 and defining superposed clamping areas W31 and W41. In the example of FIGS. 3 and 5, the eight auxiliary shedding mechanisms actually define four pairs of shedding mechanisms, distributed parallel to the weft axis Y90, wherein, for each pair, one of the auxiliary shedding mechanisms is supported by the girder 85, and the other is supported by the girder 86. For each pair, the auxiliary heddles driven the pair of auxiliary shedding mechanisms share the same auxiliary cumberboard and define superposed clamping areas. Thus, in the present example, only four clamping areas may defined, each clamping area being associated to two sets of auxiliary heddles. This principle may be applied regardless of the number of sets of auxiliary heddles and auxiliary shedding mechanisms.

Alternatively, only one girder may be implemented, supporting all the auxiliary shedding mechanisms. Alternatively, more than two girders may be implemented with any suitable distribution of the auxiliary shedding mechanisms thereon.

The loom 2 comprises a single rapier system, or any other suitable insertion means 90, for inserting weft into the open main and auxiliary sheds of main and auxiliary warp yarns, for weaving the fabric 1. The insertion means 90 are located along the weft axis Y90 of the loom 2. In the present example, the insertion means 90 are a single rapier system comprising a rapier 91, shown schematically in FIG. 5. In the case of a single rapier system, a single weft is inserted at each pick. In the case of a double or multiple rapier, several new weft yarns may be inserted in parallel at each pick.

The insertion means 90 are configured for, at each pick, i.e. at each weaving cycle, picking a new weft to be inwoven. For example, a new weft 100 is picked from a weft delivery unit 94. The weft 100 is picked at a pickup position P94 along the weft axis Y90. As shown in FIG. 5, the pickup position P94 is located outside from the main harness width W11 i.e. beside the main shed 14 of main warp yarns 12, in direction Y1. For picking the weft 100, the rapier 91 is preferably provided with a terminal clamp 92 shown schematically on FIG. 5.

An example of weft delivery unit 94 is shown in FIG. 1 and is configured to deliver new weft to be picked at the pickup position P94. Preferably, the unit 94 comprises different weft yarn packages, each weft yarn package including a weft yarn with a given type of reinforcement fiber like carbon, Kevlar, aramid or glass, or a weft yarn with a different nominal diameter. In this case, the weft delivery unit 94 may include a weft selector, so that the required weft yarn may be picked at each pick.

The insertion means 90 are configured for drawing the weft 100 from the pickup position P94 along the weft axis Y90, by translating a front extrimity of the weft 100 in a direction opposite to the direction Y1, through any shed of warp yarns open around axis Y90. As illustrated in FIG. 5, the rapier 91 is pulled in the direction opposite to the direction Y1 with the terminal clamp 92 holding the front extrimity of the weft 100. The trajectory of the rapier 91 and of the weft 100 is along the axis Y90.

The insertion means 90 comprise cutting means 93, such as scissors located along axis Y90, outside from the main harness width W11, on the same side than the pickup position P94. During or after drawing, the drawn weft 100 is cut by the cutting means 93 at the appropriate length. The length of the drawn weft may be varied by cutting the weft 100 off the delivery unit 94 for different positions of the rapier 91 along the weft axis Y90.

After drawing, the insertion means 90 release the weft 100 at a given position along the weft axis Y90, such as a position P91 shown in FIG. 5. In this releasing given position P91, the drawn weft 100 is entirely arranged within the main harness width W11. In particular, the two weft ends of the weft 100 are arranged within the main harness width W11. For releasing the weft 100, the terminal clamp 92 is opened. Releasing the weft 100 determines the future position of the weft 100 in the fabric 1, parallel to direction Y1.

These sub-steps of picking, drawing and releasing constitute a step of inserting the weft into the open sheds of warp yarns.

The loom 2 advantageously comprises a reed 95, actuated by a non represented sley, and movable between the heddles and the cloth fell 3. In FIG. 4, the reed 95 is shown in its initial position in continuous lines, and its beating position in dashed lines. The reed 95 is configured to beat up the inserted weft 100 against the cloth fell 3 at the end of each pick, so as to set the position the weft 100 along direction X1 relative to the fabric 1.

As shown in FIG. 5, each pick stack of the fabric 1 comprises a main part 111, comprising inwoven weft and main warp yarns 12 and being devoid of auxiliary warp yarns. In other words, the auxiliary warp yarns are not woven in the main part 111 of the fabric 1. The main part 111 is woven by means of the main heddles 11 and the main shedding mechanism 15.

Also, for at least some of the pick stacks of the fabric 1, such as the one shown in FIG. 5, the fabric 1 comprises clamping parts, such as clamping parts 112, 113 and 114 shown in FIG. 5. Each clamping part is adjacent to the main part 111 and formed over one of the clamping areas. For example, the clamping part 112 is formed at the clamping area W21, the clamping part 113 is formed at the clamping area W31 and the clamping part 114 is formed at the clamping area W41. Each clamping part comprises inwoven weft extrimity and auxiliary warp yarns, and is preferably devoid of main warp yarn. In particular, the clamping part 112 is woven with auxiliary warp yarns 22, by means of the heddles 21 and the mechanism 25, the clamping part 113 is woven with the yarns 32, heddles 31 and mechanism 35, whereas the part 114 is woven with the yarns 42, heddles 41 and mechanism 45.

Each clamping part is formed at an extrimity of one weft or several successive weft yarns, when said extrimity or extrimities do(es) not reach the end of the main harness width W11. In other words, a clamping part is formed when the concerned weft is shorter than the main harness width, for at least one extrimity of said weft. If the other extrimity of said weft reaches the other extrimity of the main harness width W11, then no clamping part is formed at the extrimity of the main part 111. Each clamping part is formed for only one layer, or for several successive layers for which the weft extrimity is positioned at the same location along axis Y90, ie. within the same clamping area. One clamping part may regroup several extrimities of successive weft, located at the same position along the weft axis Y90.

In each layer comprising two clamping parts, the main part 111 does not extend beyond the clamping parts but extends only between the clamping parts. For example, in layer L0, the clamping parts 112 and 113 are woven on each side of the main part 111, and the main part 111 only extends between the clamping parts 112 and 113.

In each layer comprising only one clamping part, the main part 111 extends to the other end of the main harness width W11. For example, a clamping part 115 forms the left end of the layer L2, while the main part 111 extends from the clamping part 115 to the opposite end of the layer L2, said opposite end being at a location corresponding to the end of the main harness width W11.

In each layer where the weft has the same length than the harness width W11, no clamping part is provided and the main part extends from one end to the other of the concerned layer.

Preferably, the auxiliary heddles related to two clamping parts overlapping or superposed in the same clamping area, but concerning opposed sides of the fabric 1 relative to direction Z1, such as the auxiliary heddles 31 and 41, are hosted through the same auxiliary cumberboard, here for example the cumberboard 37. Preferably, the auxiliary shedding mechanisms dedicated to the clamping parts of an upper side of the fabric 1, such as the mechanisms 25 and 35, are supported by the upper girder 85, whereas the auxiliary shedding mechanisms dedicated to the clamping parts of the lower side of the fabric 1, such as the mechanism 45, are supported by the lower girder 86.

Since the clamping part are woven thanks to the auxiliary heddles and shedding mechanisms, separate from the main shedding mechanism, it is easy to select different type of yarns, different weaving patterns and/or different weaving parameters for the clamping parts than for the main part. Advantageously, cheap polypropylene yarns can be used as auxiliary warp yarns for optimizing their clamping function of main warp yarns, instead of using expensive Carbon warp material, which may be only used as main warp yarns.

The loom 2 enables executing a method for weaving the multilayer fabric 1.

The loom 2 is configured to implement several successive picks, each pick corresponding to the weaving of an additional weft into the fabric 1.

Figure 6:
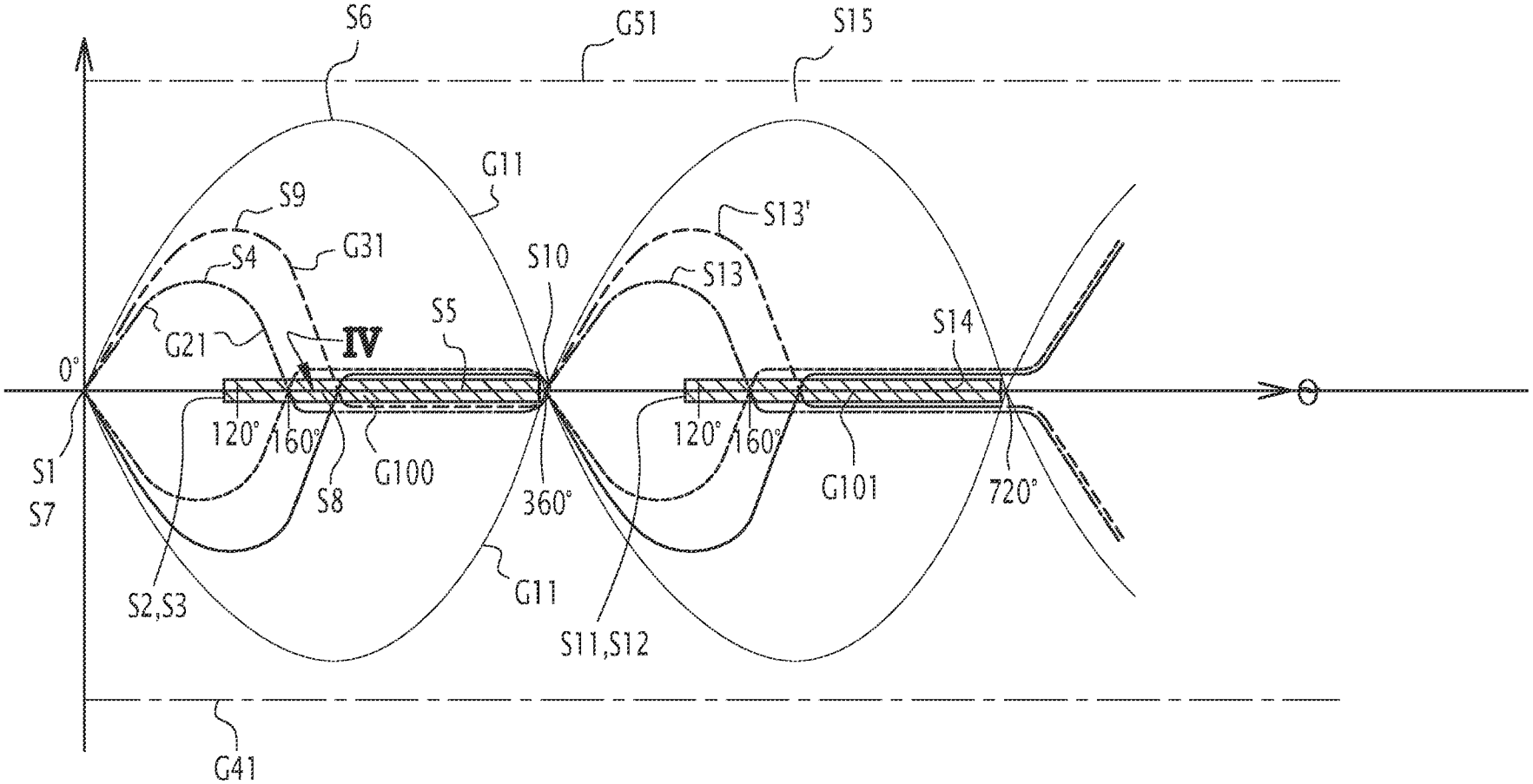
FIG. 6 is a schematic view of a profile of moving heddles of the weaving loom of FIGS. 1-5.

Among the successive picks, the loom 2 is configured to implement a pick, designated as "first pick", illustrated in FIGS. 4-6.

The profile of movement of the main heddles 11 and of the auxiliary heddles 21 and 31 are shown in FIG. 6.

In FIG. 6, the horizontal axis represents the rotation angle θ of the main shaft of the main shedding mechanism 15. During a single pick, the main shaft makes one turn, i.e. rotates from 0° (degrees), at the beginning of the first pick, to 360°, at the end of the first pick. FIG. 6 shows two entire successive picks, including the first pick on the left.

In FIG. 6, the vertical axis represents the position Z of the concerned heddles parallel to direction Z1, where 0 represents the crossing point position.

In FIG. 6, the curves G11 represent the main heddles 11. The curves G21 represent the auxiliary heddles 21. The curves G31 represent the auxiliary heddles 31. The line G100 represents the insertion of the weft 100 into the sheds by the insertion means 90. The beginning of line G100 represents the time when the insertion means just picked the weft 100. The thickness of the line G100 symbolically represents a configuration of the auxiliary shed for clamping the weft 100. The end of the line G100 represents the end of the pick.

The symbol "IV" indicates the timing corresponding to FIG. 4 and top view of FIG. 5.

The auxiliary heddles 21 and 31 are distributed over axis Y90, so that the clamping area W21 is arranged between the clamping area W31 and the pickup position P94. These two clamping areas W21 and W31 are separated along axis Y90, so that several main warp yarns 12 and corresponding main heddles 11 are arranged between the auxiliary warps yarns 22 moved by the heddles 21 and the auxiliary warp yarns 32 moved by the heddles 31.

As shown by curve G11 in FIG. 6, during an initial step S1, started at θ=0°, the main shed 14 is opened by the main heddles 11, moved by the main shedding mechanism 15. The opening of the main shed 14 is maximal at θ=180°. Reference S1 in FIG. 6 shows the starting time of the step S1.

At another step S6, successive to step S1, here started at θ=180°, the main shed 14 is closed by the main heddles 11, moved back by the main shedding mechanism 15. The closing of the main shed 14 is achieved at θ=360°. The opening and closing profile of the main heddles 11 is preferably a ring-bell profile, as shown in FIG. 6, i.e. a sinusoidal profile.

As shown by curve G21 in FIG. 6, during step S1, started at θ=0°, the auxiliary shed 24 is opened by the auxiliary heddles 21, moved by the corresponding auxiliary shedding mechanism 25. The opening of the auxiliary shed 24 is interrupted before θ=180°. Here, the opening of the auxiliary shed 24 is interrupted approximately at θ=120°. This value depends on the position of the clamping area W21 along weft axis Y90. The closer the clamping area W21 to the pickup position P94, the smaller angle for interrupting the opening of the heddles 21. At another step S4, successive to step S1 but executed before step S6, here started at θ=120°, the auxiliary shed 24 is closed by the auxiliary heddles 21, moved back by the concerned auxiliary shedding mechanism 25. The closing of the auxiliary shed 24 is achieved before the main heddles 11 achieve closing of the main shed 14, or even before the main heddles 11 start closing the main shed 14.

As shown by curve G31 in FIG. 6, during a step S7, started at θ=0°, the auxiliary shed of the auxiliary warp yarns 32 is opened by the auxiliary heddles 31, moved by the corresponding auxiliary shedding mechanism 35. The opening of this auxiliary shed is interrupted before θ=180°. Here, the opening of this auxiliary shed is interrupted approximately at θ=160°. This value depends on the position of the clamping area W31 of along weft axis Y90. The closer the clamping area W31 to the pickup position P94, the smaller angle for interrupting the opening. At a step S9, successive to step S7 but executed before step S6, here started at θ=160°, this auxiliary shed is closed by the auxiliary heddles 31, moved back by the concerned auxiliary shedding mechanism 35. The closing of this auxiliary shed is achieved before the main heddles 11 achieve closing of the main shed 14, or even before the main heddles 11 start closing the main shed 14. The closing of the auxiliary shed of auxiliary warp yarns 32 is achieved after the closing of the auxiliary shed 24 of warp yarns 22. In alternative the opening of the auxiliary shed or the closing occurs after 180°.

The auxiliary shedding mechanisms defined above, including the actuators 81 and 82, enable that the opening and closing profiles of the auxiliary sheds shown in FIG. 6 are different than ring-bell profiles. Thus, closing of the auxiliary sheds by the auxiliary heddles can be achieved at any desired timing, in particular before the main shed is closed by the main heddles. Closing the auxiliary shed refers to approaching, driving or pulling two auxiliary warp yarns close to the crossing point. With the presence of weft within the auxiliary shed, the weft is clamped. Depending on the thickness of the weft, the shed remains slightly open around the weft, so that the shed is "semi-closed". The term "closing" is intended to encompass such a slight opening or semi-opening configuration.

During the aforementioned steps S1, S4, S6, S7 and S9, the other auxiliary heddles are preferably closed and put away from the crossing-point, so as not to interfere with the weaving of the layer L0. For example, as shown by the curve G41 in FIG. 6, the auxiliary heddles 41 are positioned at a bottom position, lower than the maximal position of the lower main heddles 11 when the main shed 14 is fully open, so that the corresponding auxiliary shed is closed and placed under the main shed 14. If other auxiliary heddles are provided, such as the one for forming the clamping part 115, they may also be positioned higher than the maximal position of the upper main heddles 11 when the main shed 14 is fully open, as shown by the curve G51.

In parallel from the execution of steps S1, S4, S6, S7 and S9 by the heddles and shedding mechanisms, the insertions means 90 are configured for executing a step S2 of picking the weft 100 at the pickup position P94. For example, this step S2 is preferably started at 100°.

The step S2 is preferably preceded by a step of selection of the required weft package by the weft selector of the delivery unit 94, from which the weft 100 shall be picked. In an embodiment, once the sheds are sufficiently open by the heddles, the rapier 91 is quickly translated by an actuator of the insertion means 90 along the weft axis Y90, after step S1 and before step S2, for reaching the pickup position P94. The step S2 then includes picking, i.e. catching of the weft 100 by the terminal clamp 92. The picking S2 is achieved slightly before the heddles 21 are done opening, i.e. before S4 is started.

Immediately after the picking S2, the insertion means 90 start a step S3 of drawing the picked weft 100 in a direction opposite to the direction Y1, along the weft axis Y90. For this purpose, for example, the rapier 91 is pulled by said actuator in a direction opposite to the direction Y1, thus pulling the weft 100 by its extrimity caught in the terminal clamp 92.

During drawing, the weft 100 first passes through the clamping area W21, i.e. is inserted into the auxiliary shed 24 of auxiliary warp yarns 22 opened by the heddles 21. During passing of the weft 100 through the auxiliary shed 24, step S4 of closing said shed 24 is started, so that the auxiliary shed 24 is preferably closed as soon as the front end of the weft 100 and thus the rapier 91, are out from the clamping area W21. Thus, closing of the auxiliary shed 24 is operated before closing of the main shed 14 and before the weft 100 is completely drawn, so as to clamp, i.e. guide the translation of the weft 100 at the clamping area W21 with the auxiliary warp yarns 22. The weft 100 being clamped, it is precisely guided and positioned during the drawing. In other words, the weft is secured while the main shed is open, or also before the shed is closed. In other words, the weft is stabilized in position before the main shed closes. In other words, the auxiliary shed 24 of the auxiliary warp yarns 22 anticipates the motion of the main warp yarns 12 during the pick, like the main warp yarns will close the main shed a certain time after the insertion means have released the weft yarn, which is favorable to obtain a reliable position of the inserted weft within the fabric 1. In other words, the inserted weft yarn can be kept stretched in the fabric thanks to the auxiliary warp yarns of clamping area.

The tension of the auxiliary warp yarns 22 is preferably increased while closing the auxiliary shed 24 is operated, for a stronger clamping the weft 100 with the tensioned auxiliary warp yarns 22. Increasing of the tension may be obtained through the warp delivery means, through the cloth beam or through an additional mechanism which might be programmed.

The drawing S3 of the weft 100 continues as the auxiliary shed 24 is closed, so that the weft 100 is inserted through the open main shed 14 between the clamping areas W21 and W31, while being clamped by the auxiliary warp yarns 22. In other words, the auxiliary shedding mechanism 25 closes the auxiliary shed 24 for clamping the weft 100 with the auxiliary warp yarns 22 after the insertion means 90 have drawn the first weft 100 through the first clamping area W21 and while the insertion means 90 are still drawing the weft 100 into the open main shed 14.

Preferably, the auxiliary shedding mechanism 25 is configured for closing the auxiliary shed 24 so that the weft 100 is clamped in the clamping area W21 while the weft 100 is drawn through the clamping area W31.

When the front extrimity of the weft 100 reaches the clamping area W31, where the second auxiliary shed of auxiliary warp yarns 32 is open. Then, the drawing S3 includes drawing the weft 100 into the second auxiliary shed in the clamping area W31. During or before passing of the weft 100 through the auxiliary shed of auxiliary yarns 32, step S9 of closing said auxiliary shed is started, so that the auxiliary shed of auxiliary yarns 32 is preferably closed as soon as the front extrimity of the weft 100 and thus the rapier 91, are out from the clamping area W31. This step S9 is shown in FIG. 4 and in the top part of FIG. 5. Thus, closing of the auxiliary shed of auxiliary warp yarns 32 is operated before closing of the main shed 14 is achieved, or even started, and before the weft 100 is completely drawn, so as to clamp, i.e. guide the translation of the weft 100 at the clamping area W31 with the auxiliary warp yarns 32. The weft 100 being clamped at both extrimitys, it is precisely guided and positioned during the drawing. The closing of the auxiliary shed in the clamping area W21 might occur slightly before the rapier has withdrawn from the clamping area so that the auxiliary warp yarns clamp the weft as soon as the terminal clamp is withdrawn from the clamping area.

After the picking S2 and preferably during the drawing S3, a step S8 of cutting the weft 100 is operated by the cutting means 93. Cutting is operated so that the weft 100 is at a given length equal to a distance extending from the clamping area W21 to the clamping area W31, i.e. a length shorter than the main harness width W11. Thus, once drawn through both clamping areas W21 and W31, each extrimity of the weft 100 is positioned at one of the clamping areas W21 and W31 as shown in FIG. 5. The weft 100 preferably does not extend, or only slightly extends, beyond the clamping areas W21 and W31. Thus, an economy of weft is obtained. Nevertheless, the weft 100 is precisely and correctly positioned, since clamped at both extrimities in the clamping areas W21 and W31.

Alternatively, the weft may be cut at the predetermined length and stored in a magazine before the step of drawing.

Once the drawing S3 is finished and the weft 100 is in the required position along the weft axis Y90, i.e. the front extrimity of the weft 100 is at position P91, the insertion means 90 release the weft 100 at a step S5, preferably after the main shed 14 starts closing at S6, but before the main shed 14 is completely closed. The release is preferably operated after the auxiliary shed of auxiliary warp yarns 32 is completely closed, and thus the weft 100 is clamped in the area W31. For this purpose, the terminal clamp 92 is opened. After releasing S5 and before the main shed 14 is completely closed, the insertion means 90 are withdrawn from the main harness width W11, for example by pulling the rapier 91 in direction Y1 until the rapier 91 is completely outside from the main harness width W11.

The weft 100 is beat up by the reed 95 after withdrawal of the insertion means 90 and before the main shed 14 is completely closed.

At the end of the first pick, the clamping part 112 is formed at the clamping area W21, the clamping part 113 is formed at the area W31, and a portion of the main part 111 is formed in between the parts 112 and 113 for the layer L0.

Then, a successive pick according to the same pattern may be executed with another weft to be inserted, for a successive layer, such as layer L1 shown in FIG. 5, and for the same pick stack or a successive pick stack. If the layer to be formed includes two clamping parts, two sets of auxiliary heddles are successively opened and closed as explained above, while the other auxiliary heddles are positioned away. If the layer should include only one clamping part, like clamping part 115 of layer L2 of FIG. 5, only one set of auxiliary heddles is successively opened and closed, while the other auxiliary heddles are positioned away. If the layer is to be devoid of clamping part, as for example layer L3, all the auxiliary heddles are positioned away.

In detail, for weaving the layer L1 of the same pick stack than layer L0, and immediately successive to layer L0, an immediately successive pick is advantageously executed after the first pick, designated as "second pick". The second pick is illustrated on FIG. 6, from θ=360° to θ=720°. In FIG. 6, the line G101 represents the insertion of the weft 100 into the sheds. The second pick comprises steps similar to the steps executed during the first pick, and summarized below.

This second pick includes a step S10 of opening the main shed 14. The main shed 14 is opened with a pattern different than at the first pick, so that a weft 101 of the layer L1 may be inserted in the same pick stack, under the weft 100. More precisely, the main shed 14 opens under the weft 100. Thus, in the main part 111 of the fabric 1, the weft 100 and 101 are separated by main warp yarns 12 delimiting the layers L0 and L1.

Step S10 also comprises opening the auxiliary sheds of auxiliary warp yarns 22 and 32 by means of the auxiliary heddles 21 and 31.

The second pick includes a step S11, wherein the insertion means 90 pick the second weft 101 at the pickup position P94 after the insertion means 90 have translated through the shed after the starting of step S10, and the second pick includes a step S12, wherein the insertion means 90 draw the weft 101 from the pickup position P94 into the main shed and into the reopened two auxiliary sheds of auxiliary warp yarns 22 and 32. At a step S13, the auxiliary shed of auxiliary warp yarns 22 is closed by means of the auxiliary heddles 21, after the weft 101 passes through the clamping area W21 and while the weft 101 is still being drawn, preferably before the weft 101 reaches the second clamping area W31. At this time, the main shed is still open. Alternatively it might start closing so that the main shed is still partly open. At a step S13', the auxiliary shed of auxiliary warp yarns 32 is closed by means of the auxiliary heddles 31, after the weft 101 passes through the clamping area W31. At this time, the main shed is still open. Alternatively it might start closing so that the main shed is still partly open. The main shed starts closing at a step S15, preferably after complete closure of both auxiliary sheds, and finishes closing at θ=720°. Before the main shed is closed and after the auxiliary sheds are closed, the second pick comprises a step S14 wherein the insertion means 90 release the second weft 101 when the weft 101 has reached the given position along axis Y90. After insertion of the weft 101, the weft 101 is beaten up by the reed 95 so as to be brought to the cloth fell 3, in the same pick stack than the weft 100.

In the illustrated example, the second pick differs from the first pick according to the following, so as to obtain that respective first extrimities of the weft yarns 100 and 101 are both caught in the clamping part 112, and that the respective second extrimities of the weft yarns 100 and 101 are both caught in the clamping part 113 of the fabric 1. As explained below, they differ from each other in that the auxiliary shed uncross at the end of first pick, and cross at the end of second pick.

At step S10, the auxiliary sheds of warp yarns 22 and 32 are opened so as to uncross any auxiliary warp yarns that were crossed around the weft 100 during the first pick, so that the weft 100 is temporarily freed from the auxiliary warp yarns that were binding it in the first layer. In other words, the primary and secondary auxiliary warp yarns are not inverted from the first pick to the second pick, as shown in FIG. 6. However, the weft 100 preferably remains inwoven within the fabric 1 by the main warp yarns 12 of the layer L0 during all the second pick, at least some of the main warp yarns 12 that were crossed around the weft 100 during the first pick remaining crossed also at the second pick. After insertion of the weft 101, the reed 95 beats the weft 101 against the weft 100. Thus, in the clamping parts 112 and 113, no auxiliary warp yarns separate the weft yarns 100 and 101, which are stacked together in the same pick stack shown in FIG. 5. The same clamping parts 112 and 113 are thus used for clamping the extrimitys of two weft yarns of different layers and of the same pick stack. This is possible if the concerned extrimity of the weft yarns 100 and 101 are to be positioned in the same clamping area, for example the clamping area W21.

In detail, for weaving the layer L3 in the cross section of FIG. 5 where the superposed first weft 100 and second weft 101 of layer L0 and L1 are visible, another pick is executed, designated as "middle pick", successive to the abovementioned first pick and second pick.

This middle pick comprises, at a step S16, opening of the main shed 14 by means of the main heddles 11, moved by the main shedding mechanism 15. This opening is performed in a manner that the weft 100, already inwoven, is positioned over the newly opened main shed 14. For this purpose, the main shed 14 opened at the middle pick has a different shape than it had at the preceding picks executed for the same pick stacks, including the first and second pick. For example, all the main warp yarns 12 capturing the weft 101 in the layer L1 are moved up by the main heddles 11, so that the main shed 14 is open under these main warp yarns 12 without unbinding the weft yarns 100 and 101. During the middle pick, at a step S20, the main heddles 11, moved by the main shedding mechanism 15, close the main shed 14 so that, at the end of the middle pick, the main shed is completely closed.

All the auxiliary sheds are closed during the middle pick, since the layer L3 does not require any clamping part. In particular, as the layer L3 is arranged below the layers L0 and/or L1 concerned with the auxiliary heddles 21 and 31, and that the layer L3 is not concerned with these auxiliary heddles, all these auxiliary heddles are put away from the weft axis Y90, i.e. are maintained over the weft axis Y90. In particular, as the layer L3 is arranged over the layer L7 concerned with the auxiliary heddles 41, and that the layer L3 is not concerned with these auxiliary heddles 41, all these auxiliary heddles are put away from the weft axis Y90, i.e. are maintained under the weft axis Y90. More generally, all the auxiliary heddles dedicated to the layers under the layer L7 are maintained under the weft axis Y90 during the middle pick, or during successive middle picks.

A step S17 is executed by the insertion means 90, comprising picking a weft 102, designated as "middle weft" at the pickup position P94, after the main shed 14 has started to open. At a further step S18, by means of the insertion means 90, the middle weft 102 is drawn along the weft axis Y90, from the pickup position P94 into the open main shed 14. The drawing is executed until the front extrimity of the weft 102 reaches the opposite end of the main harness width W11. At some point, the weft 102 is cut so that the weft 102 has a length equal to the main harness width W11. When the weft 102 has reached the required position along the weft axis Y90, the insertion means 90 release the weft 102 at a step S19. After withdrawing of the insertion means 90, the weft 102 is beat up before the main shed 14 is completely closed.

At the end of the middle pick, the wefts 100, 101 and 102 are superposed in the same pick stack, as shown in FIG. 1, and are located at different layers of the fabric 1, respectively layers L0, L1 and L3. In layer L3, at this pick stack, no clamping part is formed and the main part 111 occupies the full harness width W11.

A similar middle pick than the middle pick disclosed above could be implemented for weaving a layer according to the same pattern, where the middle weft would be superposed over the weft 100 instead of under the weft 100, in the same pick stack. In this case, during the middle pick, at step S16, the main shed 14 is opened so that the weft 100 is positioned under the main shed 14, instead of over the main shed 14.

After the first pick for the layer L0, the middle pick for the layer L3, a third pick may be implemented for forming the layer L7, in the same pick stack, by weaving of a weft 103.

The third pick includes, at a step S21, opening of the main shed 14 by means of the main heddles 11 and opening of two auxiliary sheds, including the auxiliary shed of auxiliary warp yarns 42 by means of the auxiliary heddles 41, for forming the clamping parts 114 and 116. These main and auxiliary sheds are open in a manner so that the middle weft 102 is positioned between the weft yarns 100 and 101 and the open sheds, so that, once the weft 103 is woven, the weft 102 is positioned between the weft 101 and the weft 103, the weft 100, 101, 102 and 103 being superposed in the same pick stack. In a step S22, the insertion means 90 pick the weft 103 at the pickup position P94. In a step S23, the insertion means 90 draw the weft 103 from the pickup position P94 into the main and auxiliary sheds. During drawing, each auxiliary shed is closed after passing through of the drawn weft 103 and before closing of the main shed 14. In particular, the auxiliary shed of yarns 42 is closed by means of the third auxiliary heddles 41, moved by the auxiliary shedding mechanism 45, for clamping the weft 103 with the auxiliary warp yarns 42 in the clamping area W41, after the insertion means 90 have drawn the weft 103 through the clamping area W41 and while the main shed 14 is still open. When the weft 103 reaches its required position along the weft axis Y90, after closing of both auxiliary sheds, the insertion means 90 release said weft 103 at a step S25. The closing of the first and second auxiliary sheds corresponds to the passage of the rapier 91, in particular le passage of the terminal clamp 92. The clamping operation for the auxiliary warp yarns follow the position of the terminal clamp 92 along the rapier axis. At the end of the pick, the main shed 14 is closed. In the finished fabric 1, as shown at the bottom of FIG. 5, the weft yarns 100, 101, 102 and 103 are superposed in the same pick stack, with the weft 102 between the weft 100 and the weft 103.

In an embodiment, at one of the picks, such as the middle pick or any other pick, the method could comprise opening the auxiliary shed 24, so that the inserted weft of this pick, for example the middle weft 102, is inserted into the auxiliary shed 24 by the insertion means 90. In this case, both weft yarns 100 and 102 would be inwoven in a same clamping part of the fabric 1 with or without being separated by auxiliary warp yarns 22. This is the case for the layers L5 and L6 shown in FIG. 5, where the weft of layer L5 and the weft of layer L6 are both inwoven in the clamping part 116. In another embodiment, the method could comprise opening the auxiliary shed of warp yarns 42, so that the inserted middle weft 102 is inserted into the auxiliary shed of warp yarns 42 by the insertion means 90. In this case, the weft of the layer L7 and the weft 102 would be inwoven in a same clamping part of the fabric 1.

When the fabric 1 is complete, or at least partially complete, the clamping parts may be cut off the main part 111 for easily obtaining a near net preform. Thus, the final structure and shape of main part 111 of the fabric 1 may be designed independently from the clamping parts, which are used to help manufacturing the main part 111.

Now turning to the embodiment of FIGS. 7-12, where a technical multilayer fabric 201 is being woven with a weaving loom similar to the one of the embodiments of FIGS. 1-6. The same terms are used for designating the similar features than in the embodiment of FIGS. 1-6. In this particular embodiment, the loom 2 has a double rapier system instead of a single rapier system, as insertion means 90, so that two superposed weft may be inserted at each pick for the same pick stack, on both sides of the fabric 201.

However, the method disclosed for FIGS. 7-12 could also apply to a case where only one weft is inserted at each pick, alike in FIGS. 1-6.

Figure 7:
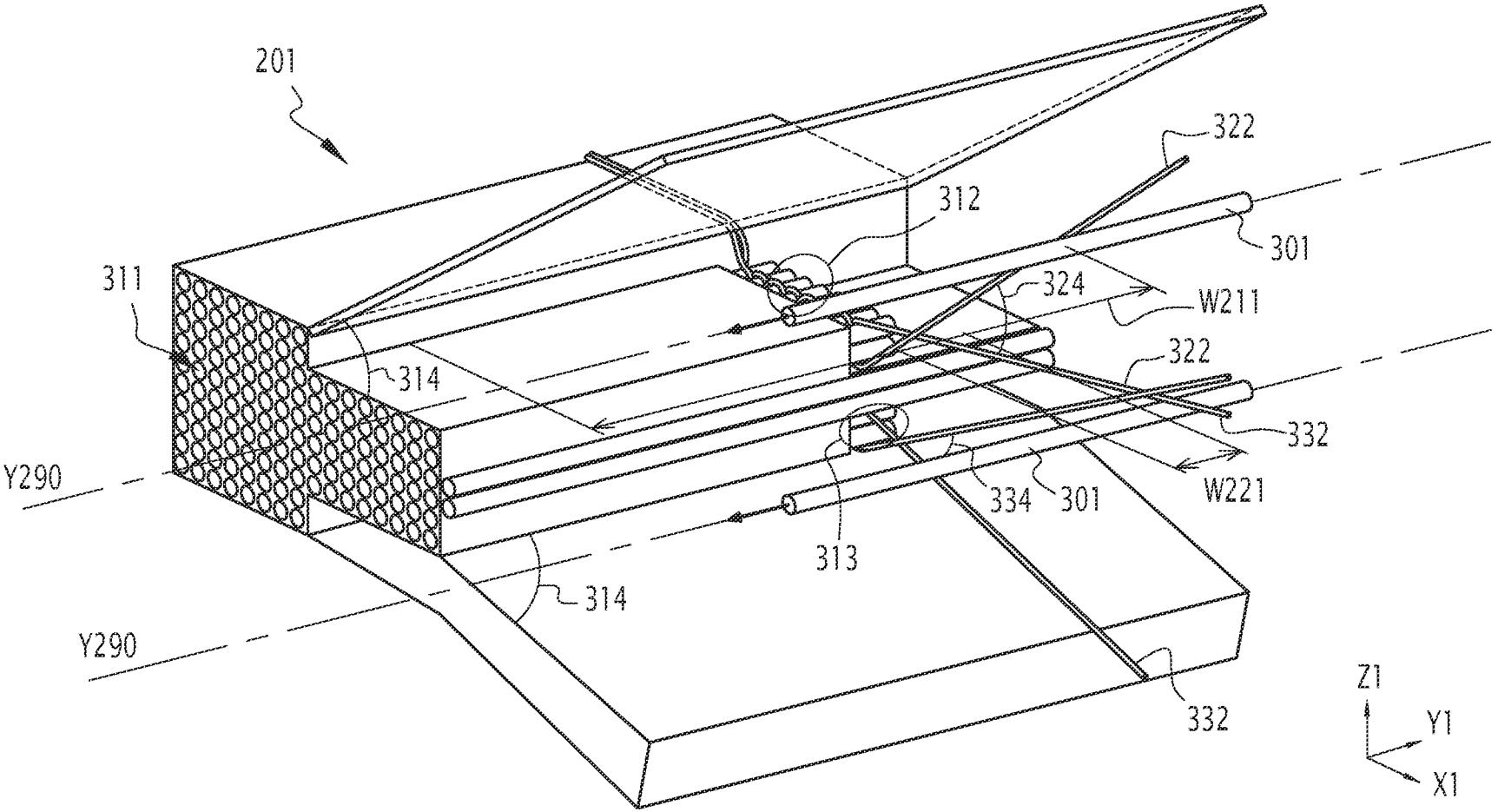
FIGS. 7-11 are schematic perspective views of another embodiment of a multilayer fabric according to the invention, during successive steps of a method which may be implemented with the weaving loom of FIGS. 1-6.

As shown in FIG. 7, the fabric 201 comprises inwoven weft and warp yarns. Only some of the weft and warp yarns are shown for simplification purpose. The fabric 201 comprises a main part 311 including inwoven main warp yarns and weft. The fabric 201 also comprises a clamping part 312, including inwoven weft and auxiliary warp yarns 322, and a clamping part 313, including inwoven weft and auxiliary warp yarns 332. The clamping part 312 extends over a clamping area W221 along the weft axis Y290, entirely arranged within a main harness width W211. The clamping part 312 is superposed with the clamping part 313, so as to extend over the same clamping area W221. As in the embodiment of FIGS. 1-6, the main warp yarns are moved by the main heddles, while the auxiliary warp yarns 322 are moved by auxiliary heddles of a first set, with a corresponding auxiliary shedding mechanism, and the auxiliary warp yarns 332 are moved by auxiliary heddles of a second set, with a corresponding auxiliary shedding mechanism.

In this embodiment of FIGS. 7-12, weaving may include a first pick similar to the first pick of FIGS. 1-6. At the first pick, two weft yarns 301 are inserted by the insertion means in parallel, each weft 301 being picked at a respective pickup position by a respective rapier, and being drawn along a respective weft axis Y290 into the open sheds of warp yarns. Preferably, the two axis Y290 are arranged in a same plane parallel to directions Z1 and Y1.

Turning to the warp yarns, at the first pick, two superposed main sheds 314 of main warp yarns are opened by means of the main heddles of the loom. Each main shed 314 is dedicated for the insertion of one of the inserted weft 301. Thus, each main shed 314 is open around one of the respective weft axes Y290. The sheds 314 are only partially shown in FIG. 6; in particular, the main warp yarns of the sheds 314 between the axes Y290 are not shown. At the first pick, two superposed auxiliary sheds of auxiliary warp yarns are also opened by respective sets of auxiliary heddles. In detail, an auxiliary shed 324 of auxiliary warp yarns 322 is opened around one of the axes Y290 by a set of auxiliary heddles arranged along the clamping area W221 and an auxiliary shed 334 of auxiliary warp yarns 332 is opened around the other axis Y290 by another set of auxiliary heddles arranged along the clamping area W221. The main warp yarns concerning the layers in between the layer of the inserted weft yarns 301 are positioned away from the sheds 314, 324 and 334, between said sheds, for example in a middle position along the vertical axis where the main warp yarns do not interfere with the said sheds if they are in the same stack, so that the main warp yarns are not part of the clamping parts of clamping area W211. Advantageously, the clamping part is not binded with the main fabric and can be easily cut and removed after weaving.

As shown in FIG. 7, the insertion means draw each weft 301 through its respective auxiliary shed 324 or 334, and through its respective main shed 314.

Figure 8:
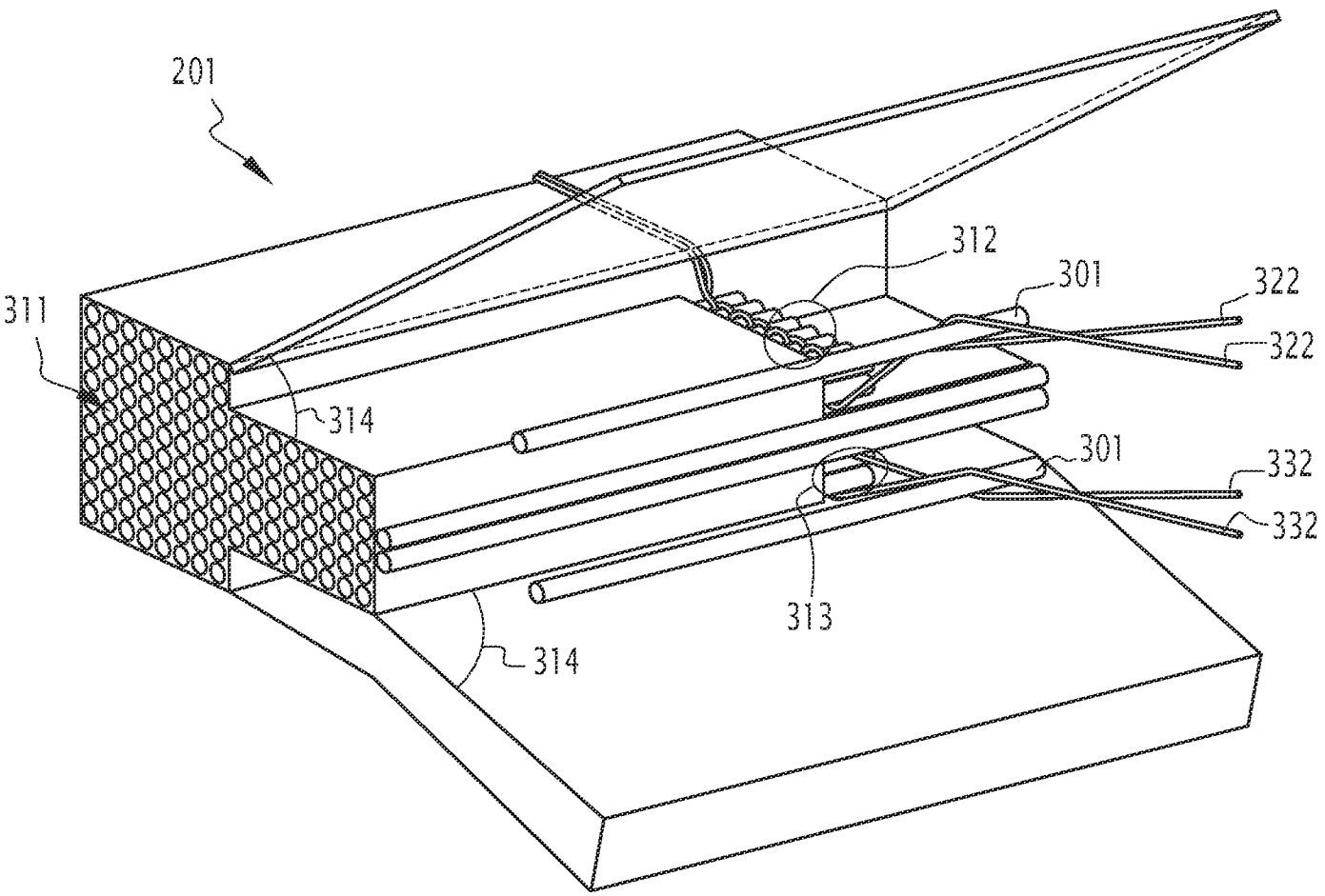

As shown in FIG. 8, once the weft yarns 301 have passed through the clamping area W221, the auxiliary sheds 324 and 334 are closed by the corresponding auxiliary heddles, before closure of the main sheds 314, so that the weft yarns 301 are clamped. One weft 301 is clamped by the auxiliary warp yarns 322 by closing the shed 324, while the other weft 301 is clamped by the auxiliary warp yarns 332 by closing the shed 334. Once the weft yarns 301 are at their final predetermined position along the weft axes Y290, they are both released by the insertion means. After withdrawal of the insertion means, then the main sheds 314 are closed and the weft yarns 301 are beaten up against the cloth fell of the fabric 201. The first pick is achieved.

Figure 9:
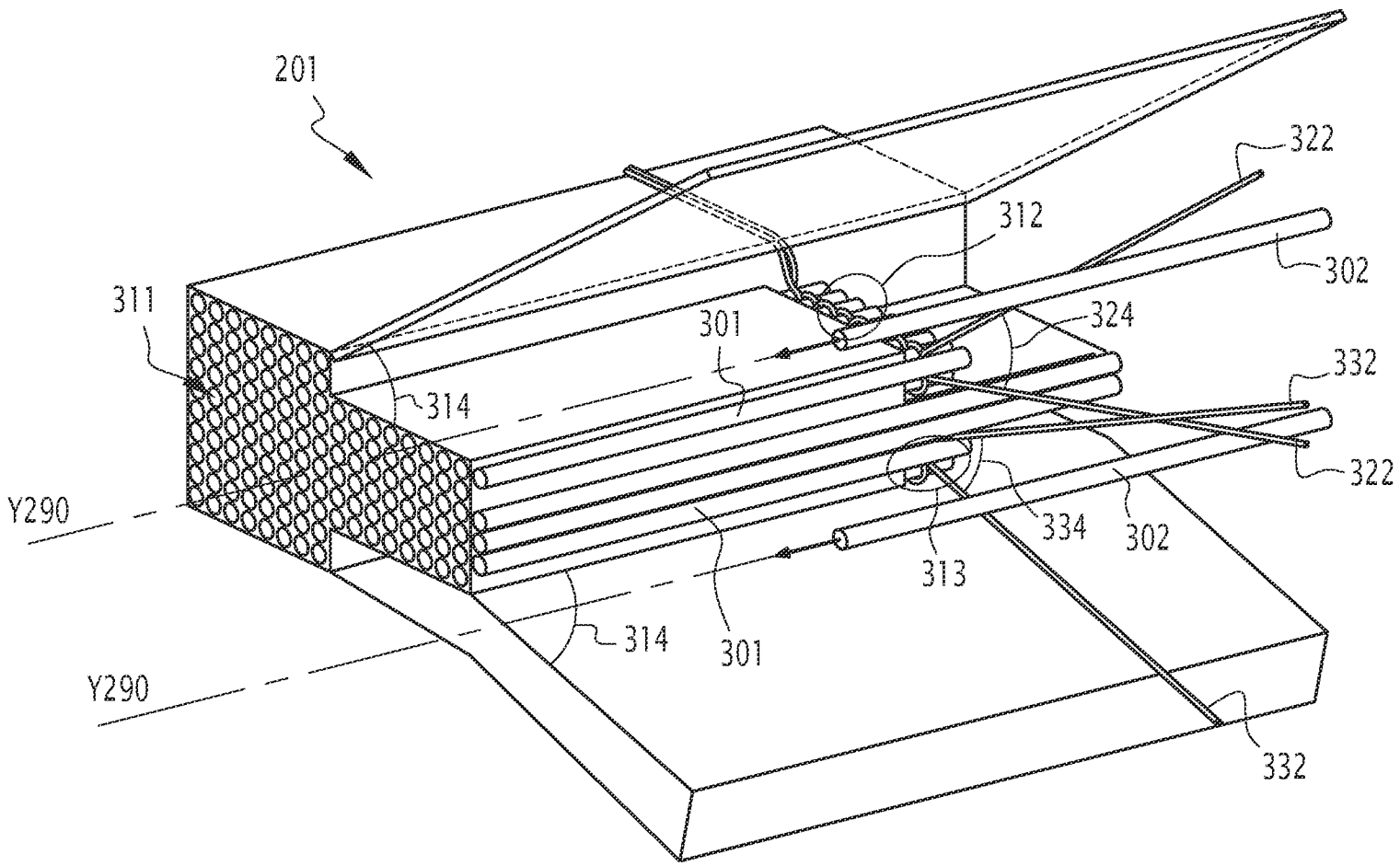
Figure 10:
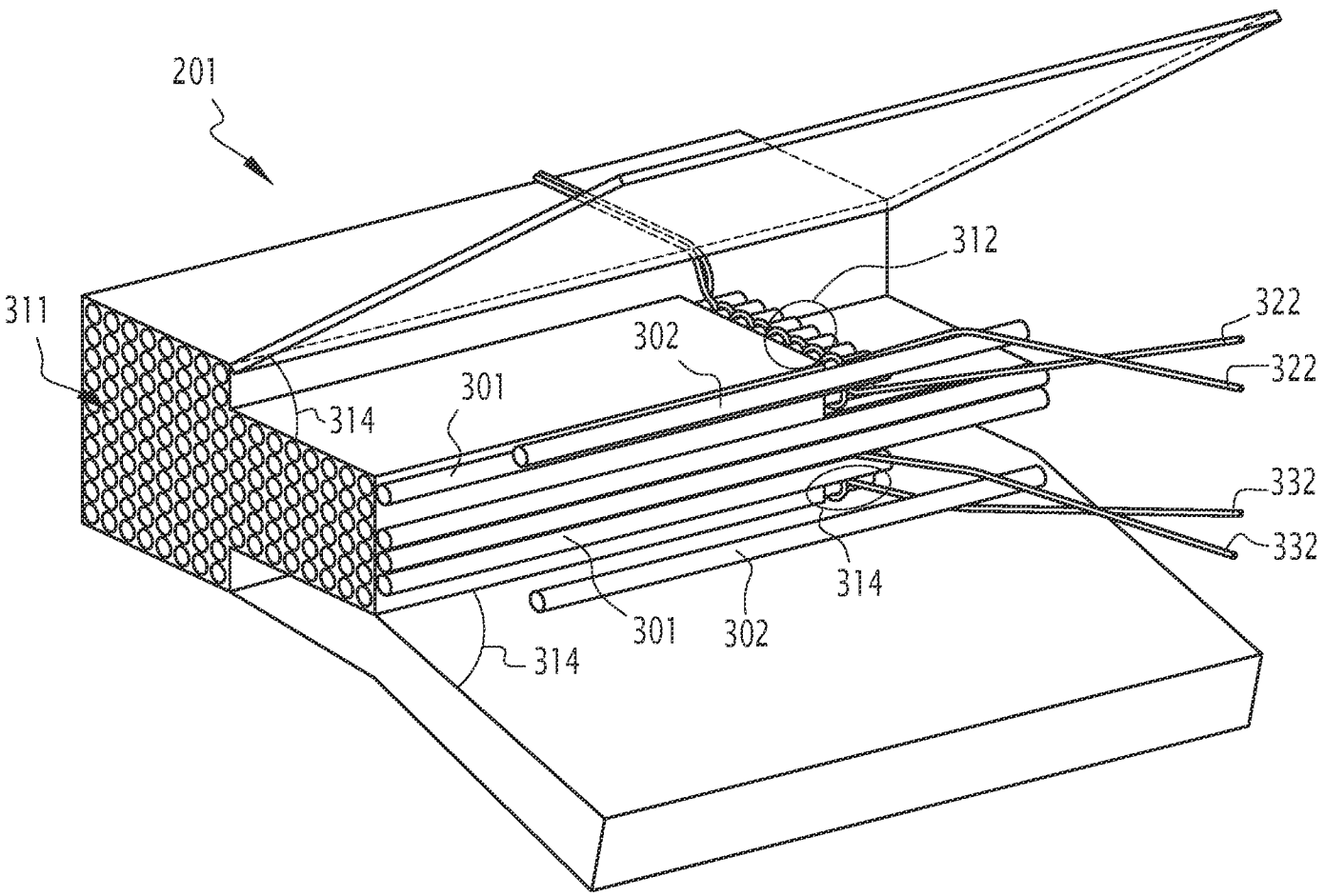
Figure 11:
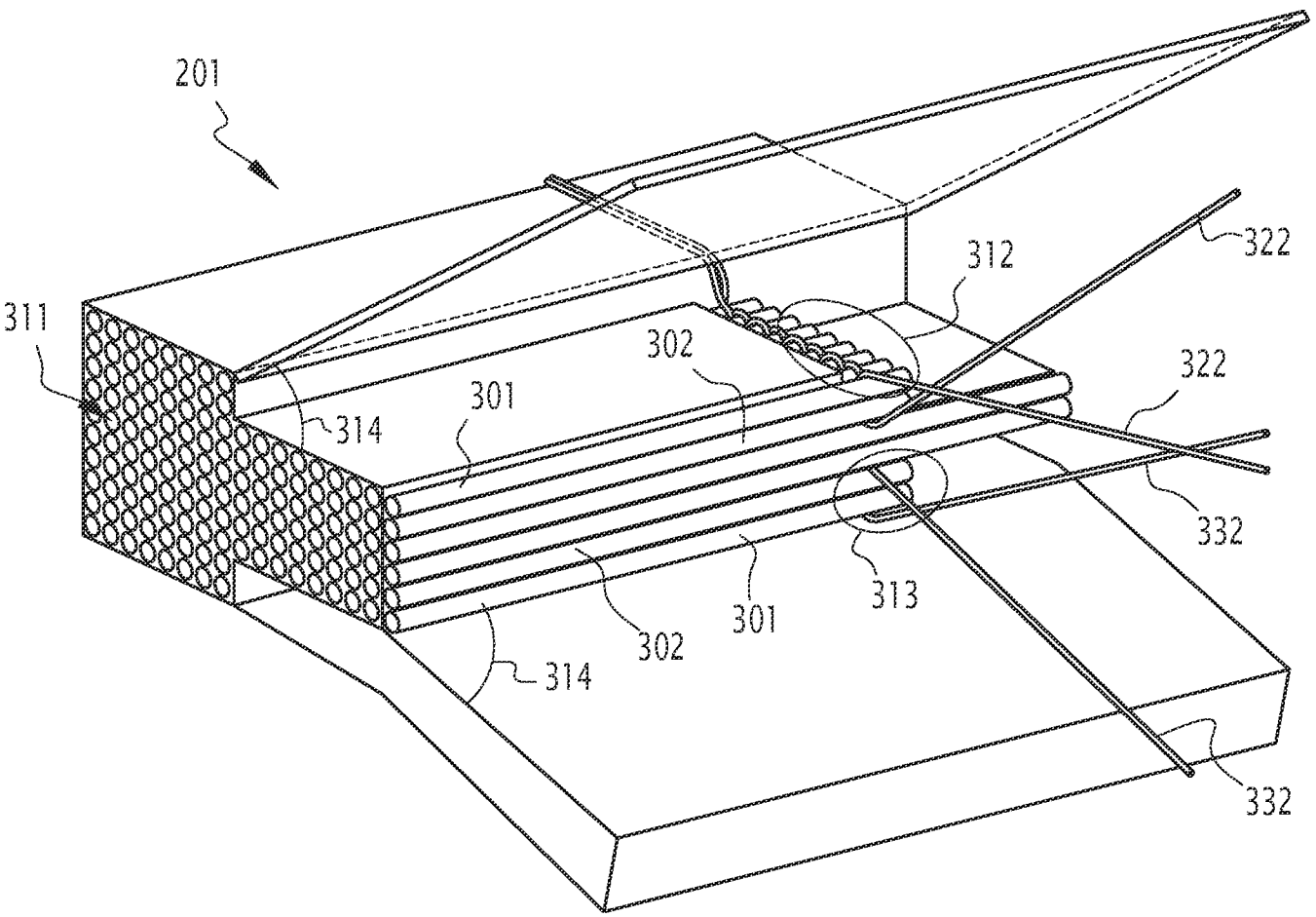

FIGS. 9-11 concern a second pick, executed after the first pick shown at FIGS. 7-8, preferably immediately after the first pick without any pick between the first pick and the second pick.

At the second pick, two additional weft yarns 302 are inserted by the insertion means in parallel, each weft 302 being picked at the two respective pickup positions by the two respective rapiers and being drawn along the two respective weft axis Y290 into the open sheds of warp yarns.

Turning to the warp yarns, at the second pick, the method comprises opening the sheds around the weft axes Y290, including opening the superposed main sheds 314 of main warp yarns, each main shed 314 being opened respectively around the axes Y290 for the insertion of one respecting weft 302. Opening the sheds also includes opening the superposed auxiliary sheds 324 and 334 in the clamping area W221, respectively for insertion of the two weft yarns 302. At this second pick, the auxiliary shed 324 is opened according to a pattern wherein any auxiliary warp yarns 322 that were crossed around the upper weft 301 are uncrossed, for freeing the extrimity of the weft 301 positioned at the cloth fell, that was clamped by closing the auxiliary shed in the clamping area W221. Similarly, the auxiliary shed 334 is opened according to a pattern wherein any auxiliary warp yarns 332 that were crossed around the lower weft 301 are uncrossed, for freeing extrimity of the lower weft 301 that was clamped by closing the auxiliary shed. Preferably, the weft yarns 301 remain attached to the cloth fell by at least some of the main warp yarns, not shown, which remain crossed around them at the cloth fell. For example, this is obtained if the closing of the main sheds 314 at the first pick crossed main warp yarns around the weft yarns 301, and if the pattern of the main sheds 314 is different at the second pick than at the first pick. In other words, this is obtained when some main warp yarns change their vertical position relative to the weft axis between the first and following second pick.

As shown in FIG. 9, the insertion means draw each weft 302 through its respective auxiliary shed 324 or 334, and through its respective main shed 314.

As shown in FIG. 10, once the weft yarns 302 have passed through the clamping area W221, the auxiliary sheds 324 and 334 are closed by the corresponding auxiliary heddles, before closure of the main sheds 314, so that the weft yarns 302 are clamped respectively by the auxiliary warp yarns 322 and by the auxiliary warp yarns 332. Since the auxiliary warp yarns 322 were uncrossed at the beginning of the second pick, the upper weft yarns 301 and 302 are caught together without being separated by any auxiliary warp yarn. Similarly, since the auxiliary warp yarns 332 were uncrossed at the beginning of the second pick, the lower weft yarns 301 and 302 are caught together without being separated by any auxiliary warp yarn. The upper weft yarns 301 and 302 are inwoven or binded in the same shed opening in the final fabric with clamping parts. The lower weft yarns 301 and 302 are inwoven or binded in the same shed opening in the final fabric with clamping parts.

Figure 12:
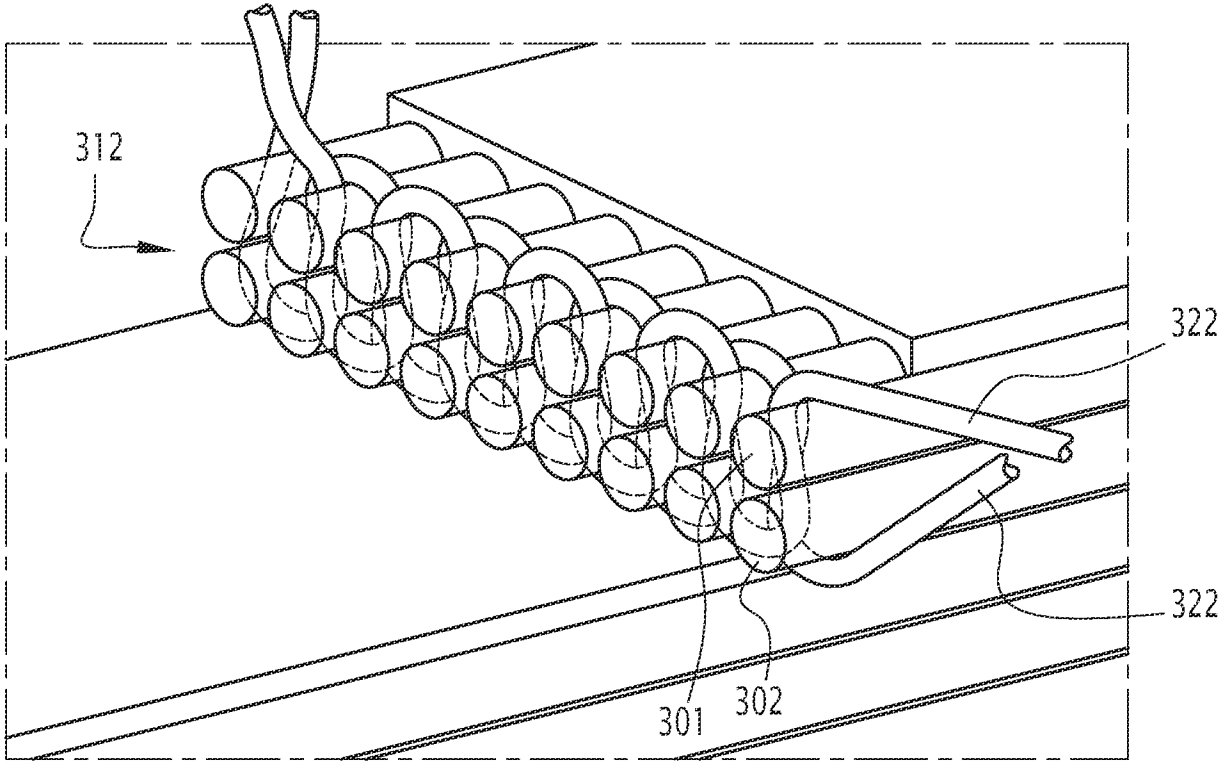
FIG. 12 is a schematic perspective view of a detail of the multilayer fabric of FIGS. 7-11.

Once the weft yarns 302 are drawn to their final predetermined position along the weft axes Y290, they are both released by the insertion means. After withdrawal of the insertion means and closure of the main sheds 314, the weft yarns 302 are beaten up against the cloth fell of the fabric 201. As shown in FIGS. 11 and 12, the upper weft yarns 301 and 302 become stacked together without being separated by any auxiliary warp yarns, only being tied by the crossed auxiliary warp yarns 322 surrounding them. Similarly, the lower weft yarns 301 and 302 become stacked together without being separated by any auxiliary warp yarns, only being tied by the crossed auxiliary warp yarns 332 surrounding them. Depending on the weaving of the main part of the fabric, the weft yarns 301 and 302 may be integrated to a single pick stacks, since they are not separated by any auxiliary warp yarns. In some cases, this may avoid that, parallel to the direction X1, the clamping parts of the fabric are too long or too short compared to the main part and creates internal stress in the fabric which raises the risk of ripping some selvedge parts of the fabric.

In the embodiment of FIGS. 7-12, two weft yarns are inserted at each pick. However, similar steps may be applied for the case of FIGS. 1-6 where only one weft is inserted at each pick, or to a case where each pick include a simultaneous insertion of more than two weft yarns.

Figure 13:
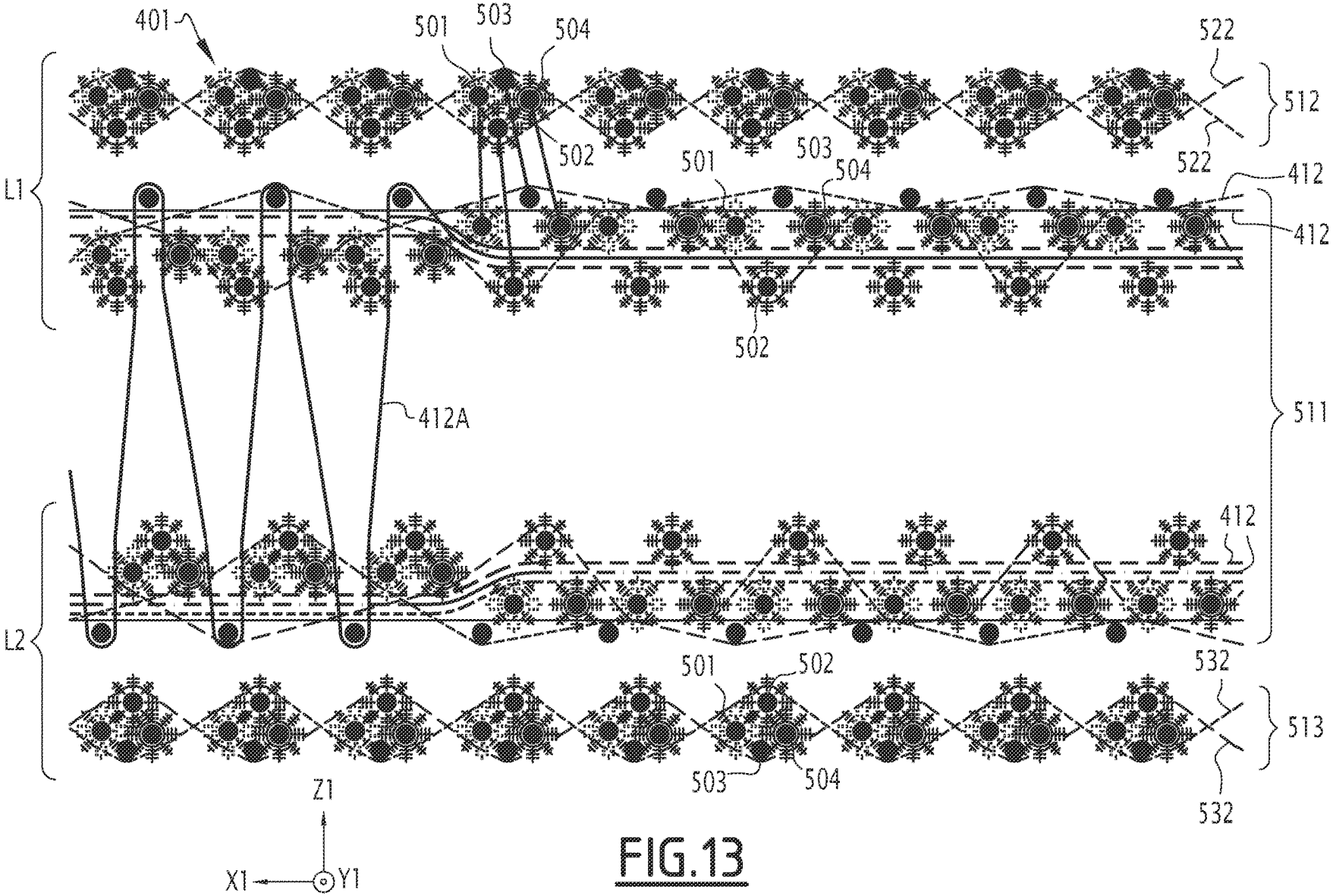
FIG. 13 is a schematic side view of a detail of another embodiment of multilayer fabric according to the invention.

FIG. 13 shows another embodiment of a fabric 401, including two clamping parts 512 and 513 distributed at respective layers L1 and L2 of the fabric 401. The clamping parts 512 and 513 respectively include inwoven auxiliary warp yarns 522 and 532. For each layer L1 and L2, groups of four weft yarns 501, 502, 503, 504 are stacked together in the clamping parts 512 and 513 without being separated by any auxiliary warp yarn. This is obtained by repeating the sequence of steps disclosed for the embodiment of FIGS. 7-12 until four weft like the weft 301 and 302 are stacked. This fabric can be obtained on a weaving loom with a single, or two superposed or more insertions means. Advantageously, thick weft yarns or elastic weft yarns like provided by Chenille bobbin can be clamped in the clamping parts. Advantageously, the take-up of the clamping parts 512 and 513 during weaving the fabric 401 parallel to direction X1, is closely the same than the take-up of the fabric 401 into the cloth beam.

The fabric 401 also includes a main part 511, extending at both layers L1 and L2. The clamping parts 512 and 513 are illustrated in an offset manner relative to the main part 511, so that the main part 511 is entirely visible.

For each layer L1 and L2, the weft yarns 501, 502, 503 and 504 extend into the main part 511 and are interwoven with main warp yarns 412 of the main part 511. Also, the main part 511 comprises binding warp yarns 412A woven with the weft yarns 502 of the layer L1 and with the weft 501 of the layer L2, so as to bind together the two layers L1 and L2.

In an embodiment, one side of the weft yarns of the fabric are locally positioned along the weft axis at each pick so that one first weft extremity of a weft is locally positioned along the weft axis, but the second weft extremity of the weft is clamped by additional warp yarns driven by a selvedge device on a harness side at the opposite of the pickup side, or by additional warp yarns driven by a selvedge device on a harness side at the pickup side.

The loom may comprise a selvedge device, for clamping a local weft before closing the main shed. This selvedge device may have the same structure as on of the auxiliary shedding mechanisms and related set of auxiliary heddles disclosed above. Otherwise, the selvedge device may be of traditional structure, ie. being mechanically driven by the weaving loom, and set on a side of the harness to for clamping the weft before closure of the main shed.

The loom may be equipped with a number and/or arrangement of auxiliary shedding mechanism, auxiliary heddles sets, for obtaining a different number and/or arrangement of clamping areas along the weft axis.

In an embodiment, one of the clamping parts of the multilayer fabric may follow a contour of the multilayer fabric warpwise so that several layers of the fabric are inwoven by auxiliary warp yarns and the multilayer has a narrowing profile in a plane parallel to the directions Y1 and Z1.

Any feature disclosed above in the context of a particular embodiment may be implemented in the other disclosed embodiments, when technically possible.

The invention claimed is:

1. A weaving loom for weaving a multilayer fabric comprising warp yarns and weft yarns, the weft yarns being of different lengths, wherein the weaving loom comprises:
- insertion means, configured for:
  - picking a weft at a pickup position along a weft axis of the weaving loom,
  - drawing the weft from the pickup position into a shed of warp yarns along the weft axis, and
  - releasing the weft at a given position along the weft axis;
- main heddles, configured for guiding main warp yarns and defining a main harness width along the weft axis;
- a main shedding mechanism of the Jacquard type, configured for moving the main heddles along a vertical path;
- a set of first auxiliary heddles, configured for guiding first auxiliary warp yarns and defining a first clamping area along the weft axis, the first clamping area being arranged within the main harness width; and
- a first auxiliary shedding mechanism, configured for moving the first auxiliary heddles;
- wherein the weaving loom is configured for, at a first pick:
  - opening a main shed of main warp yarns by means of the main heddles, moved by the main shedding mechanism, and opening a first auxiliary shed of first auxiliary warp yarns by means of the first auxiliary heddles, moved by the first auxiliary shedding mechanism, for the insertion of a first weft by the insertion means; and
  - closing the first auxiliary shed by means of the first auxiliary heddles, moved by the first auxiliary shedding mechanism, for clamping the first weft with the first auxiliary warp yarns in the first clamping area, after the insertion means have drawn the first weft through the first clamping area and while the main shed is still open.

2. The weaving loom according to claim 1, wherein the first auxiliary shedding mechanism is configured for closing the first auxiliary shed for clamping the first weft while the insertion means are still drawing the first weft into the main shed.

3. The weaving loom according to claim 1, wherein:
- the weaving loom comprises:
  - a set of second auxiliary heddles, configured for guiding second auxiliary warp yarns and defining a second clamping area along the weft axis, the second clamping area being arranged within the main harness width;
  - a second auxiliary shedding mechanism, configured for moving the second auxiliary heddles;
- the first clamping area is arranged between the pickup position and the second clamping area; and
- the weaving loom is configured for, at said first pick:
  - opening a second auxiliary shed of second auxiliary warp yarns, by means of the second auxiliary heddles, moved by the second auxiliary shedding mechanism, for the insertion of the first weft by the insertion means, and closing the second auxiliary shed by means of the second auxiliary heddles, moved by the second auxiliary shedding mechanism, for clamping the first weft with the second auxiliary warp yarns in the second clamping area, after the insertion means have drawn the first weft through the second clamping area and while the main shed is still open.

4. The weaving loom according to claim 3, wherein the first auxiliary shedding mechanism is configured for closing the first auxiliary shed for clamping the first weft while the insertion means draw the first weft into the second clamping area.

5. The weaving loom according to claim 1, wherein the weaving loom comprises a girder, supporting the first auxiliary shedding mechanism, the first auxiliary shedding mechanism being adjustable in position along the girder, parallel to the weft axis.

6. The weaving loom according to claim 1, wherein the first auxiliary shedding mechanism comprises:

a primary actuator for moving a primary auxiliary heddle, among the first auxiliary heddles, according to a primary reciprocating movement; and a secondary actuator for moving a secondary auxiliary heddle, among the first auxiliary heddles, according to a secondary reciprocating movement opposite to the primary reciprocating movement, with an adjustable crossing point.

7. The weaving loom according to claim 1, wherein:

the first auxiliary shedding mechanism comprises at least one actuator, comprising a stator and a pulley driven in rotation relative to the stator; and each pulley is configured to move at least one of the first auxiliary heddles.

8. The weaving loom according to claim 7, wherein each pulley is configured to move three first auxiliary heddles.

9. The weaving loom according to claim 1, wherein the main shedding mechanism comprises:

selectable hooks, each driving at least one of the main heddles;

blades, for driving the selectable hooks between an upward and a downward position; and a main shaft for driving the blades.

10. A method for weaving a multilayer fabric comprising warp yarns and weft, the weft yarns being of different lengths, by means of a weaving loom comprising:

insertion means, configured for:

picking a weft at a pickup position along a weft axis of the weaving loom, drawing the weft from the pickup position into a shed of warp yarns along the weft axis, and releasing the weft at a given position along the weft axis;

main heddles, configured for guiding main warp yarns and defining a main harness width along the weft axis;

a main shedding mechanism of the Jacquard type, configured for moving the main heddles vertically along a vertical path;

a set of first auxiliary heddles, configured for guiding first auxiliary warp yarns and defining a first clamping area along the weft axis, the first clamping area being arranged within the main harness width; and a first auxiliary shedding mechanism, configured for moving the first auxiliary heddles;

wherein the method comprises, at a first pick:

opening a main shed of main warp yarns by means of the main heddles, moved by the main shedding mechanism, and opening a first auxiliary shed of auxiliary warp yarns by means of the first auxiliary heddles, moved by the first auxiliary shedding mechanism;

by means of the insertion means, picking a first weft at the pickup position;

by means of the insertion means, drawing the first weft from the pickup position into the main shed and into the first auxiliary shed;

closing the first auxiliary shed by means of the first auxiliary heddles, moved by the first auxiliary shedding mechanism, for clamping the first weft with the first auxiliary warp yarns in the first clamping area, after the insertion means have drawn the first weft through the first clamping area and while the main shed is still open;

by means of the insertion means, releasing the first weft; and by means of the main heddles, closing the main shed.

11. The method according to claim 10, wherein during said first pick, the first auxiliary shedding mechanism closes the first auxiliary shed for clamping the first weft:

after the insertion means have drawn the first weft through the first clamping area; and while the insertion means are still drawing the first weft into the main shed.

12. The method according to claim 10, wherein:

the weaving loom comprises:

a set of second auxiliary heddles, configured for guiding second auxiliary warp yarns and defining a second clamping area along the weft axis, the second clamping area being arranged within the main harness width;

a second auxiliary shedding mechanism, configured for moving the second auxiliary heddles;

the first clamping area is arranged between the pickup position and the second clamping area; and;

the method comprises, at said first pick:

opening a second auxiliary shed, by means of the second auxiliary heddles, moved by the second auxiliary shedding mechanism, wherein drawing the first weft by means of the insertion means comprises drawing the first weft into the second auxiliary shed, and closing the second auxiliary shed by means of the second auxiliary heddles, moved by the second auxiliary shedding mechanism, for clamping the first weft with the second auxiliary warp yarns in the second clamping area, after the insertion means have drawn the first weft into the second clamping area, while the main shed is still open, and before the insertion means release the first weft.

13. The method according to claim 12, wherein the method further comprises, at said first pick:

after picking the first weft, cutting the first weft at a given length equal to a distance from the first clamping area to the second clamping area, along the weft axis.

14. The method according to claim 10, wherein the method further comprises, at a second pick executed after the first pick:

opening the main shed by means of the main heddles, moved by the main shedding mechanism, and opening the first auxiliary shed by means of the first auxiliary heddles, moved by the first auxiliary shedding mechanism;

by means of the insertion means, picking a second weft at the pickup position;

by means of the insertion means, drawing the second weft from the pickup position into the main shed and into the first auxiliary shed;

closing the first auxiliary shed by means of the first auxiliary heddles, moved by the first auxiliary shedding mechanism for clamping the second weft with the first auxiliary warp yarns in the first clamping area, after the insertion means have drawn the second weft through the first clamping area and while the main shed is still open;

by means of the insertion means, releasing the second weft; and by means of the main heddles, closing the main shed;

wherein opening the first auxiliary shed at the second pick comprises uncrossing any first auxiliary warp yarns that were crossed around the first weft during the first pick, so that, at the end of the second pick, the first weft and second weft are stacked together without being separated by any first auxiliary warp yarn.

15. The method according to claim 10, wherein:

the weaving loom comprises:

a set of third auxiliary heddles, configured for guiding third auxiliary warp yarns and defining a third clamping area along the weft axis, the third clamping area being arranged within the main harness width;

a third auxiliary shedding mechanism, configured for moving the third auxiliary heddles;

the method further comprises, at a middle pick executed after the first pick:

opening of the main shed by means of the main heddles, moved by the main shedding mechanism, so that the first weft is positioned over or under the main shed;

by means of the insertion means, picking a middle weft at the pickup position;

by means of the insertion means, drawing the middle weft from the pickup position into the main shed;

by means of the insertion means, releasing the middle weft; and by means of the main heddles, moved by the main shedding mechanism, closing the main shed, so that the first weft and the middle weft are superposed in a same pick stack;

the method further comprises, at a third pick executed after the middle pick:

opening of the main shed by means of the main heddles, moved by the main shedding mechanism, and opening of a third auxiliary shed of third auxiliary warp yarns by means of the third auxiliary heddles, moved by the third auxiliary shedding mechanism, so that the middle weft is positioned between the first weft and the main shed;

by means of the insertion means, picking a third weft at the pickup position;

by means of the insertion means, drawing the third weft from the pickup position into the main shed and into the third auxiliary shed;

closing the third auxiliary shed by means of the third auxiliary heddles, moved by the third auxiliary shedding mechanism, for clamping the third weft with the third auxiliary warp yarns in the third clamping area, after the insertion means have drawn the third weft through the third clamping area and while the main shed is still open;

by means of the insertion means, releasing the third weft; and by means of the main heddles, closing the main shed, so that the first weft, the middle weft and the third weft are superposed in a same pick stack, with the middle weft between the first weft and the third weft.

16. The method according to claim 15, wherein the method comprises, during the middle pick:

maintaining the first auxiliary heddles over the weft axis; and maintaining the third auxiliary heddles under the weft axis.

17. The method according to claim 15, wherein the method comprises, at the middle pick:

opening the first auxiliary shed by means of the first auxiliary heddles, moved by the first auxiliary shedding mechanism, so that the middle weft is inserted into the first auxiliary shed by the insertion means; and/or opening the third auxiliary shed by means of the third auxiliary heddles, moved by the third auxiliary shedding mechanism, so that the middle weft is inserted into the third auxiliary shed by the insertion means.

18. The method according to claim 10, wherein the method comprises, at the first pick, increasing a tension of the first auxiliary warp yarns while closing the first auxiliary shed for clamping the first weft with the tensioned first auxiliary warp yarns.

* * * * *